US007134160B2

(12) United States Patent
Tawara et al.

(10) Patent No.: US 7,134,160 B2
(45) Date of Patent: Nov. 14, 2006

(54) CLEANING DEVICE

(75) Inventors: Hirotoshi Tawara, Sumida-ku (JP); Yukio Noda, Sumida-ku (JP); Tokuji Noguchi, Sumida-ku (JP)

(73) Assignee: Kao Corporation, Tokyo (JP)

( * ) Notice: Subject to any disclaimer, the term of this patent is extended or adjusted under 35 U.S.C. 154(b) by 121 days.

(21) Appl. No.: 10/815,850

(22) Filed: Apr. 2, 2004

(65) Prior Publication Data

US 2004/0181888 A1 Sep. 23, 2004

Related U.S. Application Data

(63) Continuation of application No. PCT/JP02/09875, filed on Sep. 25, 2002.

(30) Foreign Application Priority Data

Oct. 3, 2001 (JP) ..... 2001-307972
Oct. 3, 2001 (JP) ..... 2001-307977
Oct. 3, 2001 (JP) ..... 2001-307985

(51) Int. Cl.
*A47L 11/33* (2006.01)

(52) U.S. Cl. ..... 15/41.1; 15/48; 15/52.1; 15/98

(58) Field of Classification Search ..... 15/27, 15/41.1, 44, 48, 48.1, 52.1, 82, 83, 79.1, 15/388
See application file for complete search history.

(56) References Cited

U.S. PATENT DOCUMENTS

| | | | | | |
|---|---|---|---|---|---|
| 220,413 | A | * | 10/1879 | Pittman | 15/41.1 |
| 336,728 | A | * | 2/1886 | Mack | 15/79.1 |
| 425,695 | A | * | 4/1890 | Pontious | 56/400.13 |
| 426,882 | A | * | 4/1890 | Thompson | 15/79.1 |
| 481,269 | A | * | 8/1892 | Thompson | 15/79.1 |
| 666,689 | A | * | 1/1901 | Phillips | 56/400.02 |
| 756,359 | A | * | 4/1904 | Hardy | 15/48.1 |
| 894,011 | A | * | 7/1908 | Kampfe | 15/48 |
| 1,104,613 | A | * | 7/1914 | Bodey | 15/356 |
| 1,268,988 | A | * | 6/1918 | Mason | 15/356 |
| 1,960,063 | A | * | 5/1934 | Pardee | 15/388 |
| 2,536,443 | A | * | 1/1951 | Hammell | 15/368 |
| 2,601,697 | A | * | 7/1952 | Troxler | 15/356 |
| 2,949,624 | A | * | 8/1960 | Lampe | 15/356 |
| 3,733,646 | A | * | 5/1973 | Mein | 15/369 |
| 5,239,721 | A | * | 8/1993 | Zahuranec | 15/41.1 |

FOREIGN PATENT DOCUMENTS

| | | |
|---|---|---|
| JP | 29-14570 | 11/1954 |
| JP | 38-10923 | 6/1963 |
| JP | 49-6966 | 1/1974 |
| JP | 51-77882 | 7/1976 |
| JP | 59-136766 | 9/1984 |
| JP | 59-160060 | 10/1984 |
| JP | 60-27796 | 2/1985 |
| JP | 60-63155 | 5/1985 |
| JP | 60-106568 | 7/1985 |
| JP | 61-37127 | 2/1986 |

(Continued)

*Primary Examiner*—Mark Spisich
(74) *Attorney, Agent, or Firm*—Oblon, Spivak, McClelland, Maier & Neustadt, P.C.

(57) ABSTRACT

In a cleaning device 10, a dustpan portion 23 is supported to a frame 15 so as to freely oscillate independently from a scraping up body 16 in a vertical direction, and a dust receiving portion 23C of the dustpan portion 23 is supported so as to be disconnected from the frame 15.

16 Claims, 27 Drawing Sheets

FOREIGN PATENT DOCUMENTS

| | | |
|---|---|---|
| JP | 5-5057 | 1/1991 |
| JP | 3-68857 | 7/1991 |
| JP | 5-49568 | 3/1993 |
| JP | 5-184510 | 7/1993 |
| JP | 5-91546 | 12/1993 |
| JP | 10-5159 | 1/1998 |

* cited by examiner (A)

(B)

(C)

(A)

(B)

(C)

(A)

(B)

CLEANING DEVICE

TECNICAL FIELD

The present invention relates to a cleaning device.

BACKGROUND ART

As a cleaning device, as described in Japanese Patent Application No. 1-262827, there is a structure in which a scraping up body is rotatably supported to a frame, and a dustpan portion is supported at a rear portion of the scraping up body on the frame.

The dustpan portion does not vertically oscillate independently from the scraping up body with respect to the frame. Accordingly, when the cleaning device is used for cleaning thick-piled carpet, the scraping up body only slips on the upper surface of the carpet according to a slipping motion of the scraping portion on the upper surface of the carpet, so that dust buried in the fibers of the carpet can not be scraped up by the scraping up body. In this case, when the user presses the scraping up body with a strong force in such a manner that the scraping body plunges into the fibers of the carpet, the dustpan portion is pressed strongly against the carpet so as to generate a great resistance against a forward movement, so that operability is deteriorated.

An object of the present invention is to provide a scraping up body which can securely scrape up dust while smoothly slipping a dustpan portion along a floor surface, even when the dust is buried in thick-piled carpet.

Further, as a cleaning device, there is a structure in which a scraping up body is rotatably supported to the frame, and a support axis portion on a leading end portion of a handle is connected to the frame.

Since the support axis portion of the handle is connected so as to be prevented from sliding to an upper position with respect to a gravity point position of the frame, a point of force applied to the frame via the handle by the user is far from the scraping up body, the forceis hard to be transmitted to the scraping up body, and a great force is required for rotating the scraping up body. Further, since the force point exists on the gravity point position, there is a risk that the frame pitches forward at a time when the frame moves forward.

An object of the present invention is to provide a cleaning device in which a cleaning portion can be stably lifted up from a floor surface at a time when the cleaning portion is not being used, and the scraping up body can be stably moved forward while being rotated on the floor surface by use of a small force at a time when the scraping up body is being used.

Further, as the cleaning device, there is a structure in which an adhesive roll is rotatably supported to a supporting shaft provided in the frame, and the dust on the floor surface is adsorbed and picked up by an adhesive face of the adhesive roll (Japanese Utility Model Application Laid-open No. 2-12363).

In order to replace the adhesive roll and peel off one of the adhesive sheet of the adhesive roll by one circular motion, it is necessary to attach and detach a holding means for holding the adhesive roll to the supporting shaft in each case at a time of attaching and detaching the adhesive roll.

An object of the present invention is to simplify a structure for supporting the roll and to improve its workability of attaching and detaching the roll.

Further, when a brush constituting the scraping up body scrapes up the dust while being in slidable contact with a scooping surface portion of the dustpan portion, the brush scrapes up the dust while holding the dust between a leading end of the brush and the scooping surface portion, as shown in FIG. 9(C), so that the dust drops out from the leading end of the brush and tend to be caught in failure.

When the scraping up body is buried in the fibers of the carpet so as to scrape up the dust, an edge in the scooping surface portion of the dustpan portion close to the floor surface is brought into contact with the fibers of the carpet, whereby a great resistance is generated and a heavy force for operating the cleaning device to move forward is necessary.

An object of the present invention is to reduce the dust which fails to be caught at a time when the scraping up body scrapes up the dust while being in sidable contact with the scooping surface portion of the dustpan portion.

The other object of the present invention is to lighten the operating force for moving forward the cleaning device.

Further, the brush constituting the scraping up body is constituted only by fiber members having the same bending elastic property and the same diameter, and a motion of each of the fiber members is uniform at a time when the scraping up body rolls on the floor surface. Accordingly, a forward moving operation feeling of the cleaning device is bumpy, and the continuity of a scraping up operation by the scraping up body is deteriorated.

Further, in the scraping up body constituted by fiber members having a strong bending elasticity such as thick fiber members, only the large dust can be scraped up, and in the scraping up body constituted by fiber members having a weak elasticity such as thin fibers, only the small dust can be scraped up.

An object of the present invention is to make the forward moving operation feeling of the cleaning device lithe, and to continuously scrape up all the large and small dust by means of the scraping up body.

Further, the dustpan portion does not vertically oscillate independently from the scraping up body with respect to the frame. Accordingly, when using the cleaning device for cleaning thick-piled carpet, the scraping up body only slips on the upper surface of the carpet according to the slipping motion of the dustpan portion on the upper surface of the carpet, so that the dust buried in the fibers of the carpet can not be scraped up by the scraping up body. In this case, the user presses the scraping up body with a strong force in such a manner that the scraping up body is buried in the fibers of the carpet, the dustpan portion is strongly pressed against the carpet so as to generate a great resistance against forward movement, and operability is deteriorated.

An object of the present invention is to provide a cleaning device in which the scraping up body can securely scrape up the dust while the dustpan portion smoothly slips on the floor surface, even when the dust are buried in the fibers of thick-piled carpet.

Further, as the cleaning device, there is a structure in which a scraping up body and a rotating body for rotating an adhesive roll are rotatably supported to a frame in parallel, and the adhesive roll is rotatably arranged on the scraping up body and the rotating body in parallel (Japanese Patent Application No. 2000-335014).

Further, there is a structure in which a dustpan portion is supported at a rear portion of a scraping up body in a frame, and the dustpan portion is extended along a longitudinal range below the rotating body (Japanese Patent Application No. 2001-307972).

However, the prior art has the following problems.

(1) The rotating body is formed in a straight cylindrical shape, and is in contact with the adhesive roll substantially along the entire width of the adhesive roll with no gap. Accordingly, the large dust attached to the adhesive roll after being scraped up by the scraping up body is caught by the rotating body having no gap with respect to the adhesive roll, and prevents the adhesive roll from smoothly rotating.

(2) The rotating body is formed in the straight cylindrical shape, and comes close to an inner surface of the dustpan portion substantially along the entire width of the inner portion of the dustpan portion via a small gap. Accordingly, the dust holding capacity of the dustpan portion is small.

(3) The dust scraped up by the scraping up body and fed in the dustpan portion stay in the dustpan portion ahead of the rotating body (close to the scraping up body), and the dust is prevented by the rotating body from moving to the rear side from the rotating body of the dustpan portion. The dust staying in the front side of the dustpan portion is shut off in an upper side thereof by the scraping up body, the rotating body and the adhesive roll, and it is hard for the user to view the accumulating state of the dust. Further, since the dust stays in the front side of the dustpan portion, there is a risk that the dust spills out from an intake port of the dustpan portion.

An object of the present invention is to smoothly rotate the adhesive roll adhering and picking up the dust by the rotating body, in the cleaning device.

The other object of the present invention is to secure the dust holding capacity of the dustpan portion, and to improve the visibility of the dust accumulating state, in the cleaning device.

Further, as the cleaning device, there is a structure in which a brush and a dustpan portion are supported to a frame, a driven wheel is rotated by a drive wheel rolling on the floor surface, and the brush is rotated according to the rotation of the driven wheel, as described in Japanese Patent Publication No. 57-58939.

In the prior art, it is considered that the relative speed of the brush is increased with respect to the floor surface by increasing the rotation of the brush in comparison with the rotation of the drive wheel based on a selection of an intermeshing diameter between the drive wheel and the driven wheel, thereby improving dust scraping up capacity by the brush.

However, the prior art has the following problems.

In general, in the case that the leading end of the cleaning device strikes against a wall or the like in a cleaning forward direction, the dust in a range between the wall and the brush can not be cleaned.

In the prior art, the drive wheel is arranged in a front side in the cleaning forward direction with respect to the driven wheel connected to the brush. Accordingly, the drive wheel exists between the leading end of the cleaning device and the brush, and the cleaning range becomes narrow.

Further, in the prior art, since a rotating direction of the brush is set to an opposite direction to a rotating direction of the drive wheel, a direction of scraping up the dust from the floor surface by the brush is directed to a forward side of the cleaning device in the cleaning forward direction, so that it is necessary to arrange the dustpan portion in the front side of the brush. Accordingly, the dustpan portion exists between the leading end of the cleaning device and the brush, and the cleaning range mentioned above becomes narrow.

An object of the present invention is to widen the cleaning range on the floor surface to a portion close to the wall or the like, while increasing the relative speed of the scraping up member of the scraping up body with respect to the floor surface so as to improve the dust scraping up capacity, in the cleaning device.

Further, as the cleaning device, there is a structure in which a scraping up body and an adhesive roll are supported to a frame in parallel, and the dust on the floor surface scraped up by the scraping up body are picked up by the adhesive roll, as described in Japanese Patent Application No. 2000-335014.

In Japanese Patent Application No. 2000-335014, the brush of the scraping up body and the adhesive roll are opposed to each other by rotating the adhesive roll in the opposite direction to the rotating direction of the brush, and a moving direction of the surface of the adhesive roll is made in conformity with a moving direction of the brush, in a dust transfer area for transferring the dust scraped up by the brush of the scraping up body to the adhesive roll.

However, in the prior art, there is no consideration about the relative moving speed difference between the brush of the scraping up body and the adhesive roll, in the dust transfer area mentioned above in which the brush of the scraping up body and the adhesive roll are opposed to each other, and it is impossible to smoothly take up the dust such as hair or the like entwining in the brush of the scraping up body onto the adhesive roll.

An object of the present invention is to improve the performance of taking up and picking up the dust such as the hair or the like entwined in the scraping up member of the scraping up body onto the adhesive roll, in the cleaning device.

DISCLOSURE OF THE INVENTION

In accordance with the present invention, there is provided a cleaning device comprising:

a scraping up body rotatably supported to a frame;

a dustpan portion supported at a rear portion of the scraping up body in the frame;

the dustpan portion having a bottom surface portion being in contact with a floor surface, a scooping surface portion guiding dust scraped up by the scraping up body, and a dust receiving portion receiving the dust, wherein the dustpan portion is supported so as to vertically oscillate independently from the scraping up body with respect to the frame, and wherein the dust receiving portion of the dustpan portion is supported so as to be disconnected from the frame.

Furthermore, the present invention relates to a cleaning device comprising:

a scraping up body rotatably supported to a frame; and a connection in a leading end portion of a handle connected to the frame, wherein the connection portion of the handle is connected to the frame so as to be slidable between an upper position with respect to a gravity point position of the frame, and a lower position close to the scraping up body.

Furthermore, the present invention relates to a cleaning device comprising:

a first side wall;

a second side wall; and the first side wall and the second side wall being opposed to each other, wherein a first projection having a long protruding length is provided in the first side wall, a second projection having a short protruding length is provided in the second side wall, a distance a from the first side wall to a leading end surface of the second projection is made longer than a length L of a roll, a distance b from the second side wall to a leading end surface of the first projection is made shorter than the length L of the roll, and the roll is allowed to be supported by both projections by inserting one end of a hollow portion of the roll to the first projection and thereafter inserting another end of the hollow portion of the roll to the second projection, and wherein a control projection is provided in a base portion of the first projection, a distance c from the leading end surface of the second projection to the control projection is made shorter than the length L of the roll, one end surface of the roll supported by both projections is allowed to be brought into contact with the leading end surface of the control projection in an opposing manner, and a roll supporting apparatus capable of preventing the roll from dropping out from both of the projections.

Furthermore, the present invention relates to a cleaning device comprising:

a scraping up body rotatably supported to a frame; and a dustpan portion supported at a rear portion of the scraping up body in the frame, wherein the scraping up body is constituted by a brush which is in slidable contact with a scooping surface portion of the dustpan portion so as to scrape up dust, and wherein a plurality of grooves extending along a scraping up direction of the scraping up body are provided on the scooping surface portion of the dustpan portion.

Furthermore, the present invention relates to a cleaning device comprising:

a scraping up body;

a contact rotating body;

the scraping up body and the contact rotating body being rotatably supported to a frame in parallel; and an adhesive roll rotatably arranged on the scraping up body and the contact rotating body in parallel, wherein the scraping up body is constituted by a brush formed by mixing fiber members having different bending elastic properties.

Furthermore, the present invention relates to a cleaning device comprising:

a scraping up body rotatably supported to a frame; and a dustpan portion supported at a rear portion of the scraping up body in the frame;

wherein the dustpan portion is supported so as to vertically oscillate independently from the scraping up body with respect to the frame, and wherein guide shoes warping up with respect to a floor surface are provided on both ends of a front edge of the dustpan portion.

Furthermore, the present invention relates to a cleaning device comprising:

a scraping up body;

a rotating body for rotating an adhesive roll;

the scraping up body and the rotating body being rotatably supported to a frame in parallel; and an adhesive roll rotatably arranged on the scraping up body and the rotating body in parallel, wherein the rotating body is constituted by a supporting shaft, and a rotating element which is fixed to a plurality of positions of the supporting shaft so as to be in contact with the adhesive roll, and the supporting shaft of the rotating body is separated from the adhesive roll in a portion at which the rotating element is not fixed.

Furthermore, the present invention relates to a cleaning device comprising:

a scraping up body and a dust picking means supported to a frame;

a tire by which the scraping up body rolls on a floor surface; and a scraping up member which is capable of rotatably interlocking with a rotation of the tire, and scraping up dust from the floor surface to a side of the dust picking means, wherein a speed increasing means for speeding up the rotation of the tire so as to transfer to the scraping up member is provided, and when viewing in an axial direction of the tire, a connection portion between the speed increasing means and the scraping up member is provided within a projection surface of the tire.

Furthermore, the present invention relates to a cleaning device comprising:

a scraping up body and a dust picking means supported to a frame;

a tire by which the scraping up body rolls on a floor surface; and a scraping up member rotating interlocking with a rotation of the tire, and scraping up dust on the floor surface to a side of the dust picking means, wherein a speed increasing means for speeding up the rotation of the tire so as to transfer to the scraping up member is provided, and a rotational direction of the scraping up member is set to the same direction as a rotational direction of the tire.

Furthermore, the present invention relates to a cleaning device comprising:

a scraping up body and an adhesive roll supported to a frame in parallel; and the adhesive roll picking up dust from a floor surface scraped up by the scraping up body, wherein the cleaning device has a roll driving means for rotating the adhesive roll in an opposite direction to a rotational direction of the scraping up body, wherein the roll driving means is constituted by a rotating body which rolls on the floor surface while being supported to the frame, and rotates the adhesive roll based on the rotation, wherein the rotating body has a tire rolling on the floor surface, and a rotating element rotating the adhesive roll which is capable of rotatably interlocking with the rotation of the tire, and wherein a speed increasing means for speeding up the rotation of the tire so as to transmit to the rotating element is provided.

Figure 1:
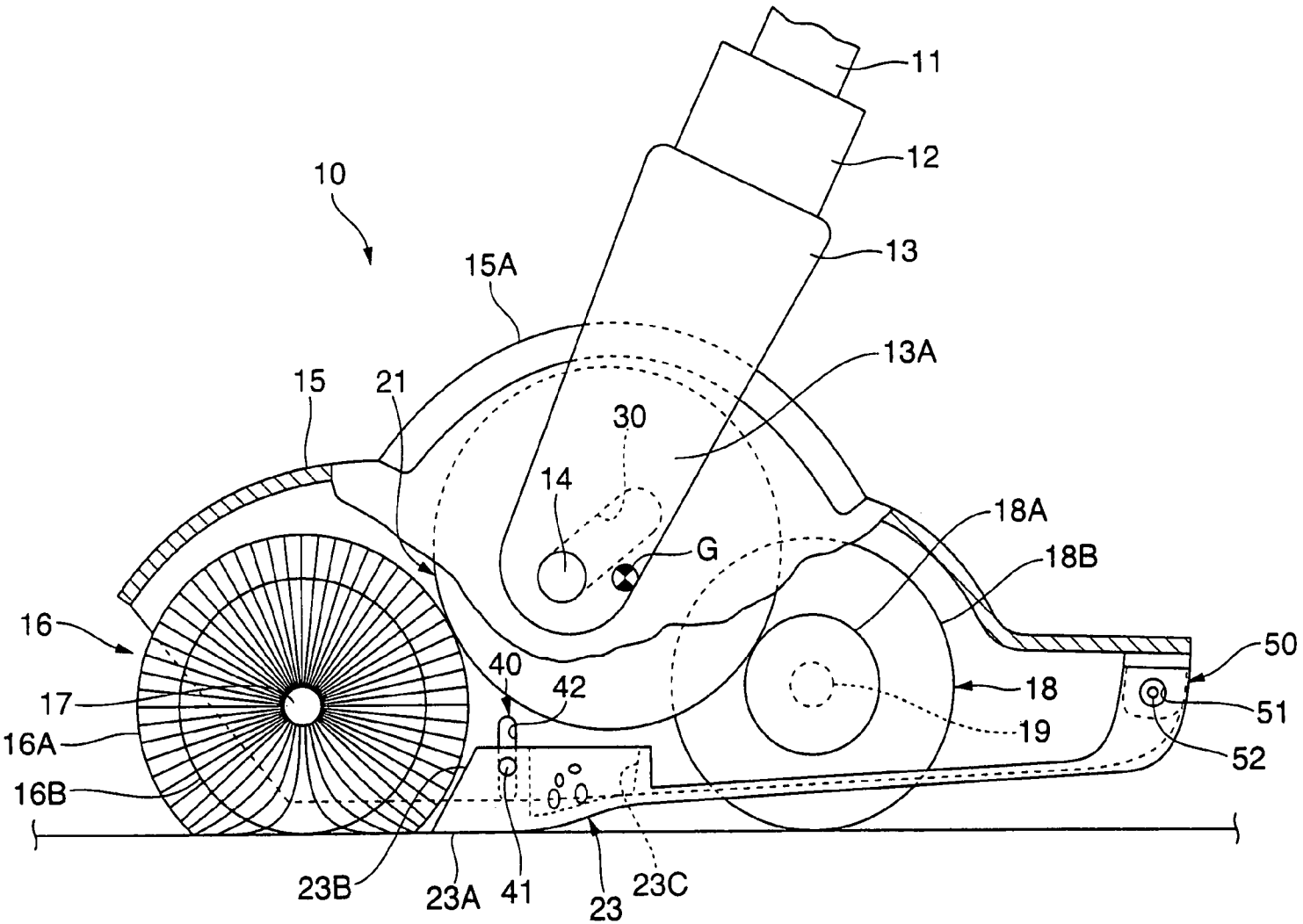
FIG. 1 is a schematic view showing a cleaning device.
Figure 2:
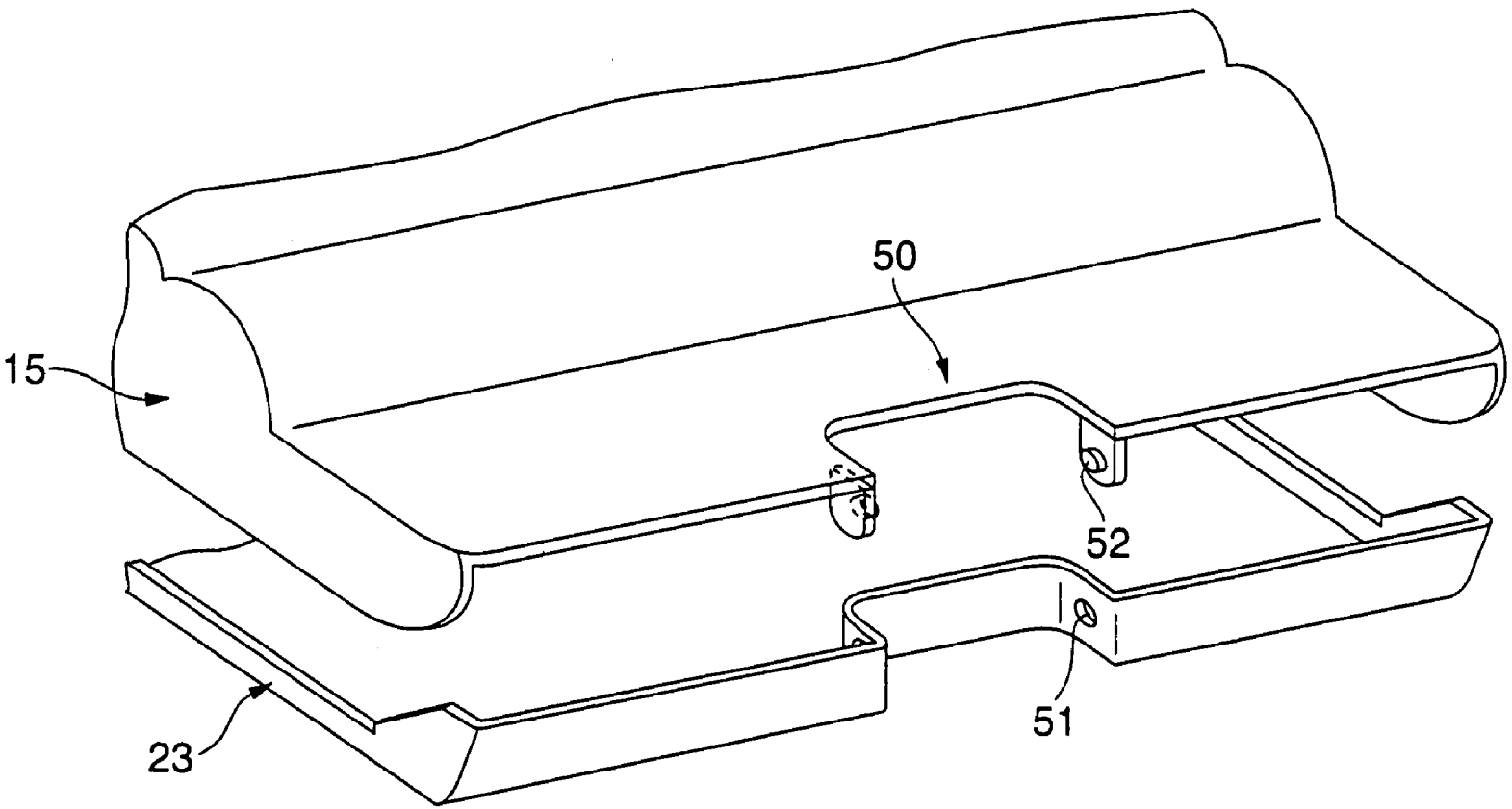
FIG. 2 is a schematic view showing an attaching and detaching portion between a frame and a dustpan portion.
Figure 3:
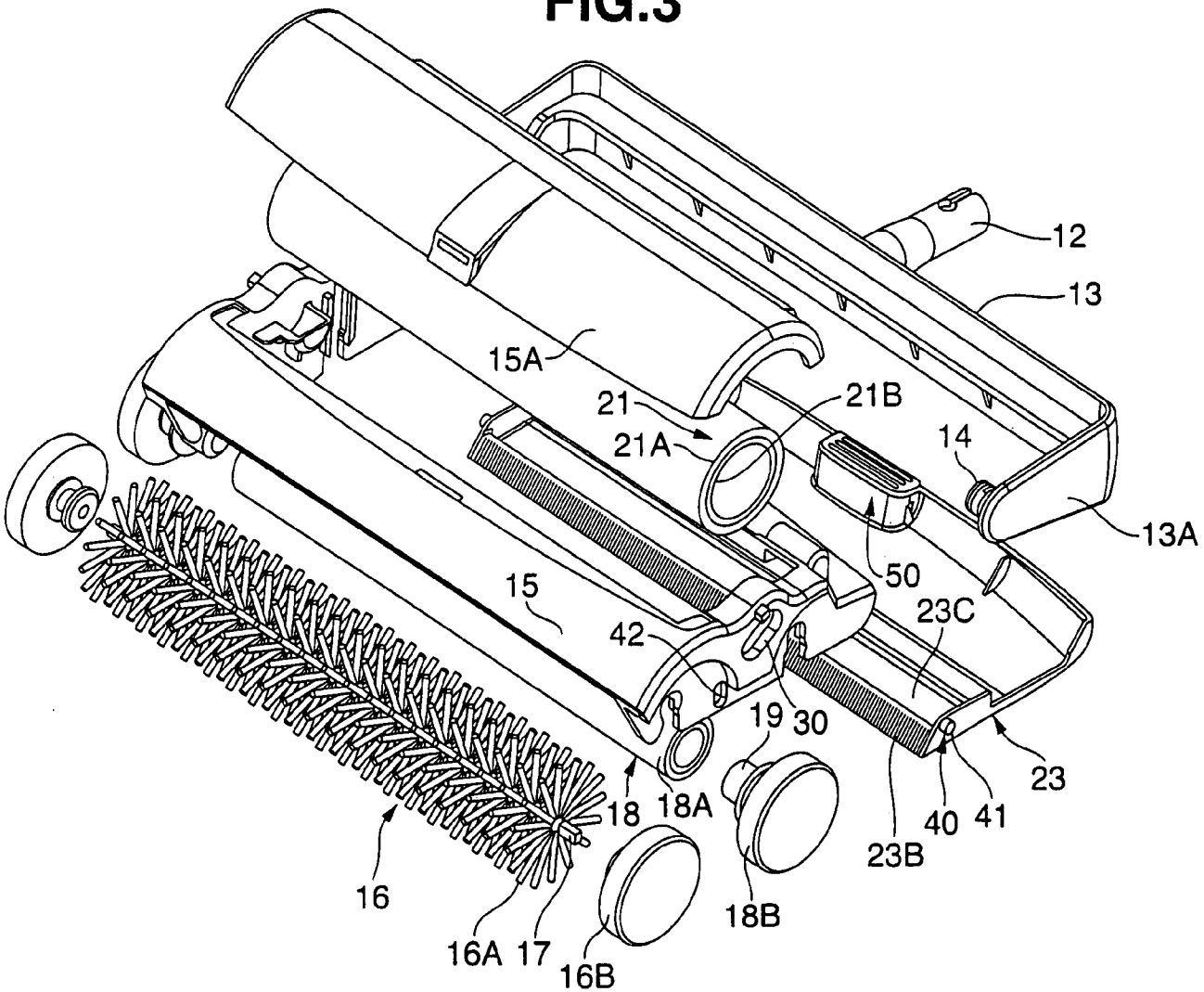
FIG. 3 is an exploded perspective view of the cleaning device.

BEST MODE FOR CARRYING OUT THE INVENTION (First Embodiment) (FIGS. 1 to 3)

A cleaning device 10 is structured, as shown in FIG. 1, such that a supporting arm 13 is connected to a leading end portion of a handle 11 via a joint portion 12 in such a manner as to freely oscillate in a lateral direction, and a frame 15 is supported on both side arm portions 13A of the supporting arm 13 via a supporting shaft portion 14 in such a manner as to freely oscillate in a longitudinal direction.

A flexible scraping up body 16 constituted by a brush is rotatably supported at a front portion of the frame 15 via a rotational shaft 17, a contact rotating body 18 constituted by a roll body is rotatably supported at a rear portion of the frame 15 via a rotational shaft 19, and the scraping up body 16 and the contact rotating body 18 are arranged in parallel. The scraping up body 16 is constituted by a scraping up portion 16A (a brush portion) and a tire portion 16B, and a scraping up diameter (a brush diameter) of the scraping up portion 16A is made larger than the tire diameter of the tire portion 16B. The contact rotating body 18 is constituted by a roll-shaped contact portion 18A and a tire portion 18B, and is structured such that an outer diameter of the tire portion 18B is made larger than an outer diameter of the contact portion 18A, both side tire portions 18B can roll on a floor surface at both outer sides of a dustpan portion 23 mentioned below, and the tire portions 18B are arranged in an inner side of the dustpan portion 23. Accordingly, the contact portion 18A is isolated from the floor by the dustpan portion 23, whereby it is possible to prevent piles or the like on the floor side from being attached to the contact portion 18A. The tire portion 18B is positioned outside the dustpan portion 23. In this case, a concavo-convex portion may be provided on a surface in the contact portion 18A of the contact rotating body 18. The concavo-convex portion corresponds to a structure obtained by applying a rib, a convex portion, a recess portion, a craping surface or the like to a roll surface of the contact portion 18A.

An adhesive roll 21 is positioned above the scraping up body 16 and the contact rotating body 18, and the adhesive roll 21 rotates so as to interlock with the rotation of the scraping up body 16 and the contact rotating body 18. A take in and out port is provided in an upper portion of the frame 15 and is covered by a detachable opening and closing cover or a transparent cover 15A. The adhesive roll 21 includes a structure of a take-up roll of an adhesive sheet or a structure having an adhesive elastomer surface reusable by being cleaned. The adhesive roll 21 according to the present embodiment is constituted by a take-up roll in which the adhesive sheet 21A is wound around a core 21B and an adhesive surface of the adhesive sheet 21A can be wound out towards an outer side and can be cut.

A dustpan portion 23 is supported at a rear portion of the scraping up body 16 in the frame 15. The dustpan portion 23 has a bottom surface portion 23A being in contact with a floor surface, and a scooping surface portion 23B faces toward the scraping up body 16 with no gap (or via a gap) and forms a curved surface shape (or a flat surface shape), and a concave dust receiving portion 23C. Further, the dustpan portion 23 is arranged so as to isolate the contact portion 18A of the contact rotating body 18 from the floor in the manner mentioned above. The dustpan portion 23 is supported to the frame 15 so as to freely oscillate vertically in the manner mentioned above, guides all the dust scraped up by the scraping up portion 16A of the scraping up body 16 to the side of the adhesive roll 21 by the scooping surface portion 23B without missing the dust rearward along the floor surface, by bringing the bottom surface portion 23A and the lowermost end portion of the scooping surface portion 23B into contact with the floor surface with no gap due to the dustpan portion's weights, and the large dust is fed into to the dust receiving portion 23C.

The cleaning operation by the cleaning device 10 is performed in the following manner.

(1) The operating force applied to the handle 11 in the axial direction moves forward the cleaning device 10, rotates the scraping up body 16 and the contact rotating body 18, and simultaneously rotates the adhesive roll 21 in an interlocking manner.

(2) When the scraping up portion 16A of the scraping up body 16 scrapes up the dust from the floor surface, the dust is guided by the dustpan portion 23 so as to be transferred to the side of the adhesive roll 21, and are adhered and picked up on the adhesive surface of the adhesive roll 21.

(3) The dust picked up on the adhesive surface of the adhesive roll 21 moves to the side of the contact rotating body 18 together with the rotation of the adhesive roll 21, and is pressed to the adhesive surface of the adhesive roll 21 by the contact rotating body 18 so as to be fixed thereto.

(4) When viewing from a transparent cover 15A that a lot of dust has been picked up in and all around the periphery of the adhesive surface of the adhesive roll 21, the cover 15A is closed after opening the cover 15A so as to peel out or cut out one periphery of the adhesive sheet 21A and expose a new adhesive surface.

In this case, the cleaning device 10 can not only move forward but also move backward. The dustpan portion 23 is formed in an upward curved shape at a tail end portion of the bottom surface portion 23A, thereby preventing the tail end portion from being caught on the floor surface at a time of backward moving.

According to the cleaning device 10 mentioned above, the dust on the carpet is scraped up by the scraping up body 16, and the dust is thereafter adsorbed and picked up by the adhesive roll 21. Since the adhesive roll 21 is not directly in contact with the carpet, it is possible to pick up the dust buried in a deep portion of the fibers in the carpet without injuring the carpet, and it is possible to improve the durability of the adhering performance of the adhesive roll 21.

Further, the same manner is applied to flooring as to carpet. Since the adhesive roll 21 is not directly in contact with the flooring, the adhesive roll 21 is never strongly adhered to the flooring and is never fixed thereto.

A description will be given below of a supporting structure of the dustpan portion 23 by the frame 15. (FIGS. 1 to 3)

The dustpan portion 23 is supported to the frame 15 so as to vertically oscillate independently from the scraping up body 16, and the dust receiving portion 23C of the dustpan portion 23 is supported so as to be freely disconnected from the frame 15.

In particular, as shown in FIG. 1, a front end in the dustpan portion 23 close to the scraping up body 16 is supported to the frame 15 by an oscillating portion 40 (structured such that pins 41 provided on both side surfaces close to the front end of the dustpan portion 23 are engageably inserted so as to vertically move in long holes 42 provided on both side walls of the frame 15) in such a manner as to freely oscillate. Further, a hole 51 of an engaging and disengaging portion 50 provided at a rear end at a distance from the scraping up body 16 in the dustpan portion 23 is formed so as to freely engage and disengage an engageable and disengageable pin 52 provided in the frame 15, and the rear end of the dustpan portion 23 is supported so as to be freely disconnected from the frame 15 by detaching the hole 51 from the engageable and disengageable pin 52. In a state in which the hole 51 of the dustpan portion 23 is engageably inserted with the engageable and disengageable pin 52 of the frame 15, the engageable and disengageable pin 52 is set to a center axis of oscillation of the dustpan portion 23. In a state in which the hole 51 of the dustpan portion 23 is detached from the engageable and disengageable pin 52 of the frame 15, the oscillating portion 40 is set to a center axis when disconnecting the dustpan portion 23.

According to the cleaning device 10 mentioned above, the following effects can be obtained.

(1) Since the structure is made such that the dustpan portion 23 can oscillate independently from the scraping up body 16, the dustpan portion 23 moves on the upper surface of the carpet in a slipping manner while the scraping up body 16 plunges into the fibers of the carpet so as to scrape up the dust. In the case that the cleaning device 10 is used for thick-piled carpet, no resistance against a forward movement is generated and an improved operability is obtained.

(2) Since the dust receiving portion 23C of the dustpan portion 23 is supported so as to be freely disconnected from the frame 15, the dust picked up in the dust receiving portion 23C can be appropriately discharged and removed by disconnecting the dust receiving portion 23C downward.

(3) In the case that the scraping up body 16 is constituted by the scraping up portion 16A and the tire portion 16B and even when the tire portion 16B plunges into the fibers of the carpet, the dustpan portion 23 moves so as to slip on the upper surface of the carpet and does not generate any resistance against forward movement.

(4) The oscillating portion 40 is provided on one end of the dustpan portion 23, and the engageable and disengageable pin 52 for disconnection is provided on another end thereof Since the oscillating portion 40 of the dustpan portion 23 is not the engaging and disengaging portion for disconnecting the dustpan portion 23, no abrasion or the like due to the attaching and detaching operation is generated in the oscillating portion 40, and it is possible to maintain the oscillating portion 40 of the dustpan portion 23 exposed to the force at a time of cleaning in a stable oscillating state (a state in which the oscillating portion 40 is not disengaged) with no abrasion.

(5) Since the dustpan portion 23 isolates the contact portion 18A of the contact rotating body 18 from the floor and prevents the contact portion 18A from directly facing the floor, the contact portion 18A does not adsorb the extra piles or the like from the floor due to static electricity, and the adhesive sheet of the adhesive roll 21 with which the contact portion 18A is in contact is durable.

(Other Effects)

(1) Since the tire portion 18B of the contact rotating body 18 is positioned in an outer side of the dust portion 23, and the outer diameter of the tire portion 18B is larger than the outer diameter of the contact portion 18A, the tire portion 18B is rotated while being pressed to the floor surface due to the weight of the cleaning device, thereby securely rotating the contact portion 18A. The contact rotating body 18 is in contact with the adhesive roll 21 and securely rotates the adhesive roll 21 in an interlocking manner. Accordingly, it is possible to evenly, efficiently and effectively utilize the adhesive surface of the adhesive roll 21 being in contact with the scraping up body 16 based on the rotation, and it is possible to securely adsorb and pick up the dust scraped up by the scraping up body 16 by the new adhesive surface of the adhesive roll 21. At this time, since the adhesive roll 21 is set in the upper side between the scraping up body 16 and the contact rotating body 18, any kind of adhesive rolls 21 having large and small outer diameters can be loaded in the cleaning device 10. Accordingly, the outer diameter of the adhesive roll 21 may be suitably manufactured, and it is possible to select an adhesive roll 21 having a suitable outer diameter in correspondence to the floor state.

(2) The dustpan portion 23 at the rear portion of the scraping up body 16 can scrape up both dust which the scraping up body 16 scrapes up from the deep portion of the fibers in the carpet, and the dust which is scraped up from the hard flat surface of the flooring at the rear side, and the dust is securely guided in the direction of the adhesive roll 21, whereby it is possible to improve dust collecting performance.

(3) Since the scraping up body 16 is provided with the tire portion 16B, the tire portion 16B is pressed to the floor surface due to the weight of the cleaning device 10 so as to be rotated, thereby securely rotating the scraping up body 16. Since the scraping up diameter is made larger than the tire diameter, the scraping up portion 16A strongly scrapes up the dust according to the scraping up force based on a restoring force of an elastic deflection, it is possible to improve the scraping up performance, and it is possible to scrape up the dust well from the deep portion of the fibers in the carpet.

(4) Since the contact rotating body 18 is provided, it is possible to press well and fix the dust adhered and picked up by the adhesive roll 21 to the adhesive surface of the adhesive roll 21.

(5) In the case that the adhesive force of the adhesive roll 21 is strong, the adhesive roll 21 and the contact portion 18A of the contact rotating body 18 rotate in an interlocking manner, and the adhesive roll 21 is hard to rotate and is heavy to operate. Accordingly, the concavo-convex portion is provided on the surface of the contact portion 18A of the contact rotating body 18. The concavo-convex portion corresponds to a structure obtained by applying a rib, a convex portion, a recess portion, a craping surface or the like to the surface of the contact portion 18A in the contact rotating body 18. In the present embodiment, it is possible to lighten the rotation by arranging at least two concavo-convex portions. In other words, providing the concavo-convex portion in the contact rotating body 18 corresponds to forming a gap between the adhesive roll 21 and the contact rotating body 18, whereby it is possible to reduce a contact area between both the elements, and it is possible to improve an operability. A preferable height of the concavo-convex portion for transferring the dust attached to the contact rotating body 18 to the adhesive roll 21 without the adhesive roll 21 and the contact rotating body 18 being closely attached, is between 0.1 and 0.5 mm, and more preferably between 0.2 and 0.4 mm.

Figure 4:
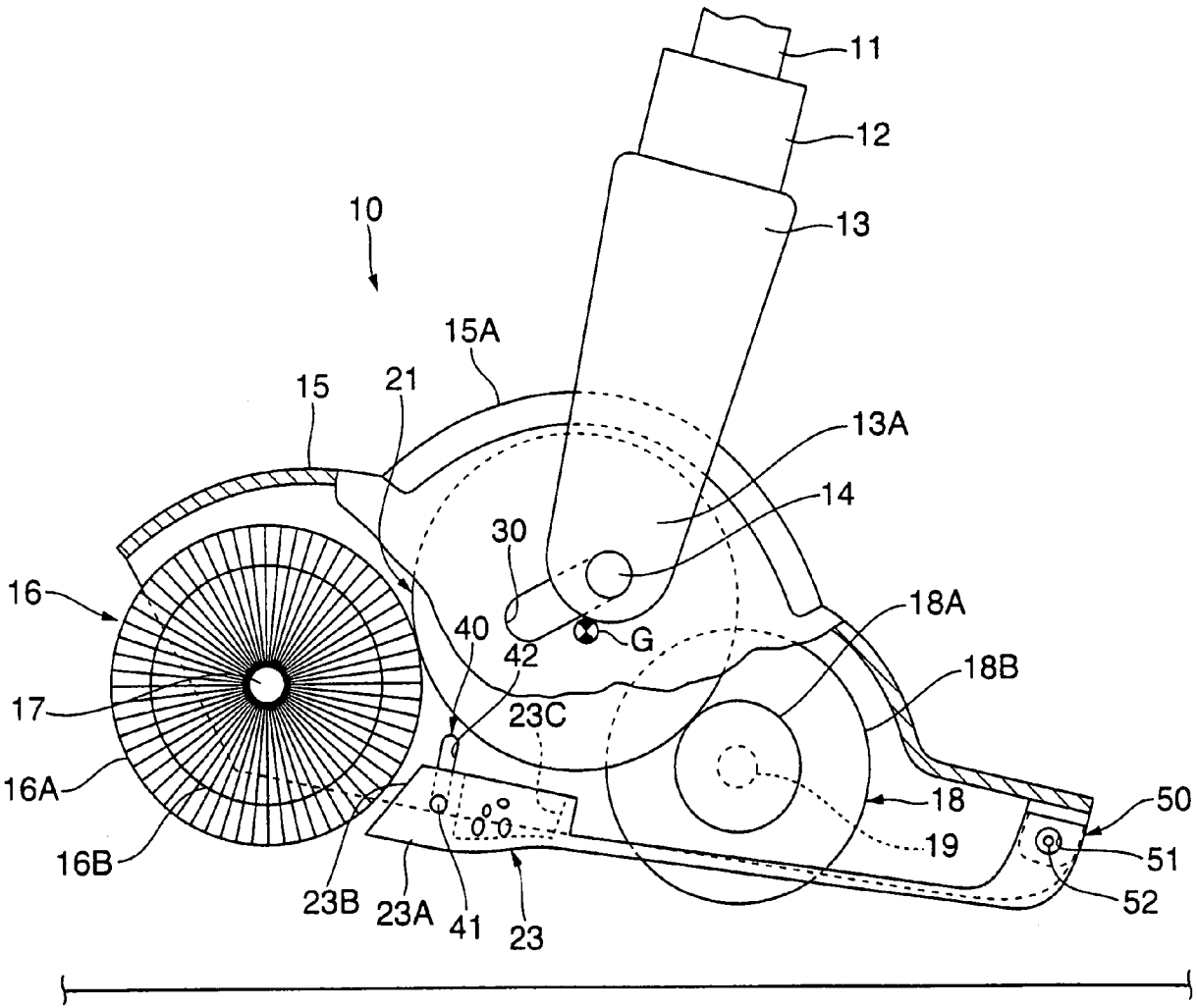
FIG. 4 is a schematic view showing an uplifted state of the cleaning device.

(Second Embodiment) (FIG. 4)

In the cleaning device 10, a supporting structure of the frame 15 in operation with the supporting shaft portion 14 at the leading end portion of the handle 11, and a supporting structure of the dustpan portion 23 by the frame 15 are structured as follows.

(A) Supporting Structure of Frame 15 by Supporting Shaft portion 14 of Handle 11

The supporting shaft portion 14 of the handle 11 is sidably connected to long holes 30 provided in both side walls of the frame 15. The long hole 30 is set upward towards an obliquely rear side in such a manner as to arrange a front end portion in a front lower portion with respect to a gravity point position G of an assembly obtained by assembling the scraping up body 16, the contact rotating body 18 and the adhesive roll 21 in the frame 15, and arrange a rear end portion just above or a rear upper portion with respect to the gravity point position G.

Accordingly, the supporting shaft portion 14 of the handle 11 is connected to the frame 15 so as to freely slide between an upper position (FIG. 4) with respect to the gravity point position G on the frame 15, and a lower position (FIG. 1) on a side of the scraping up body 16.

Therefore, according to the cleaning device 10 mentioned above, the following effects can be obtained.

(1) When lifting up the cleaning device 10 via the handle 11 in the case that the cleaning device 10 is not used, the supporting shaft portion 14 of the handle 11 slides to the upper side so as to be located at the upper position with respect to the gravity point position G of the frame 15. Accordingly, it is possible to stably lift up the frame 15 from the floor surface in a state in which the frame 15 does not turn over.

(2) When pressing the cleaning device 10 to the floor surface via the handle 11 in the case that the cleaning device 10 is used, the supporting shaft portion 14 of the handle 11 slides to the lower side so as to be located at the lower position at the side of the scraping up body 16 with respect to the gravity point position of the frame 15. Accordingly, the point at which the user applies force to the frame 15 through the handle 11 moves close to the scraping up body 16, wherein a large force can be applied to the scraping up body 16 based on such small force, and the scraping up body 16 can be rotated on the floor surface by using only a light force. Further, since the power point is under the gravity point position, the frame 15 can stably move forward on the floor surface without inverting forwardly.

Accordingly, the dust on the carpet is scraped up by the scraping up body 16, and the dust is thereafter adsorbed and picked up by the adhesive roll 21. Since the adhesive roll 21 is not directly in contact with the carpet, the carpet is not injured, it is possible to pick up the dust lying down in the deep portion of the fibers in the carpet, and it is possible to improve the durability of the adhesion performance of the adhesive roll 21.

On the flooring, the same manner as that of the carpet is applied. Since the adhesive roll 21 is not directly in contact with the flooring, the adhesive roll 21 is not strongly adhered to the flooring and is not fixed.

(3) In the case that the scraping up body 16 is constituted by a brush, the brush can be stably moved forward while being rotated on the floor surface by applying a light force, according to item (2) mentioned above.

(4) Since the supporting shaft portion 14 of the handle 11 is slidably connected to the long hole 30 of the frame 15, the supporting shaft portion 14 can be slid between the upper position with respect to the gravity point position G of the frame 15 and the lower position in the side of the scraping up body 16, based on a simple structure.

(B) Supporting Structure of Dustpan Portion 23 by Frame 15

The dustpan portion 23 is supported to the frame 15 so as to vertically oscillate independently from the scraping up body 16, and the dust receiving portion 23C of the dustpan portion 23 is supported so as to be detached from the frame 15.

Specifically, the front end close to the scraping up body 16 in the dustpan portion 23 is supported to the frame 15 in a freely oscillating manner by the oscillating portion 40 (structured such that the pins 41 provided on both side surfaces close to the front end of the dustpan portion 23 are engageably inserted so as to vertically move in the long holes 42 provided at both side walls of the frame 15). Further, the hole 51 of the engaging and disengaging portion 50 provided in the rear end far away from the scraping up body 16 in the dustpan portion 23 is formed so as to freely engage and disengage the engageable and disengageable pin 52 provided in the frame 15, and the rear end of the dustpan portion 23 is supported so as to be freely disconnected from the frame 15 by detaching the hole 51 from the engageable and disengageable pin 52. In a state in which the hole 51 of the dustpan portion 23 is engageably inserted to the engageable and disengageable pin 52 of the frame 15, the engageable and disengageable pin 52 is set to the center axis of oscillation of the dustpan portion 23. In a state in which the hole 51 of the dustpan portion 23 is detached from the engageable and disengageable pin 52 of the frame 15, the oscillating portion 40 is set to the center axis of disconnecting of the dustpan portion 23.

According to the cleaning device 10 mentioned above, the following effects can be obtained.

(1) Since the structure is made such that the dustpan portion 23 can oscillate independently from the scraping up body 16, the dustpan portion 23 moves on the upper surface of the carpet in a slipping manner while the scraping up body 16 plunges into the fibers of the carpet so as to scrape up the dust in the case that the cleaning device 10 is used for thick-piled carpet, whereby no resistance against a forward movement is generated and an improved operability is obtained.

(2) Since the dust receiving portion 23C of the dustpan portion 23 is supported so as to be freely disconnected from the frame 15, the dust picked up in the dust receiving portion 23C can be appropriately discharged and removed by disconnecting the dust receiving portion 23C toward a downward side.

(3) In the case that the scraping up body 16 is constituted by the scraping up portion 16A and the tire portion 16B and even when the tire portion 16B plunges into the fibers of the carpet, the dustpan portion 23 moves so as to slip on the upper surface of the carpet and does not generate any resistance against forward movement.

(4) The oscillating portion 40 is provided on one end of the dustpan portion 23, and the engageable and disengageable pin 52 for disconnection is provided on another end thereof. Since the oscillating portion 40 of the dustpan portion 23 is not the engaging and disengaging portion for disconnecting the dustpan portion 23, no abrasion or the like due to the attaching and detaching operation is generated in the oscillating portion 40, and it is possible to maintain the oscillating portion 40 of the dustpan portion 23 exposed to force at a time of cleaning in a stable oscillating state (a state in which the oscillating portion 40 is not disengaged) with no abrasion.

Figure 5:
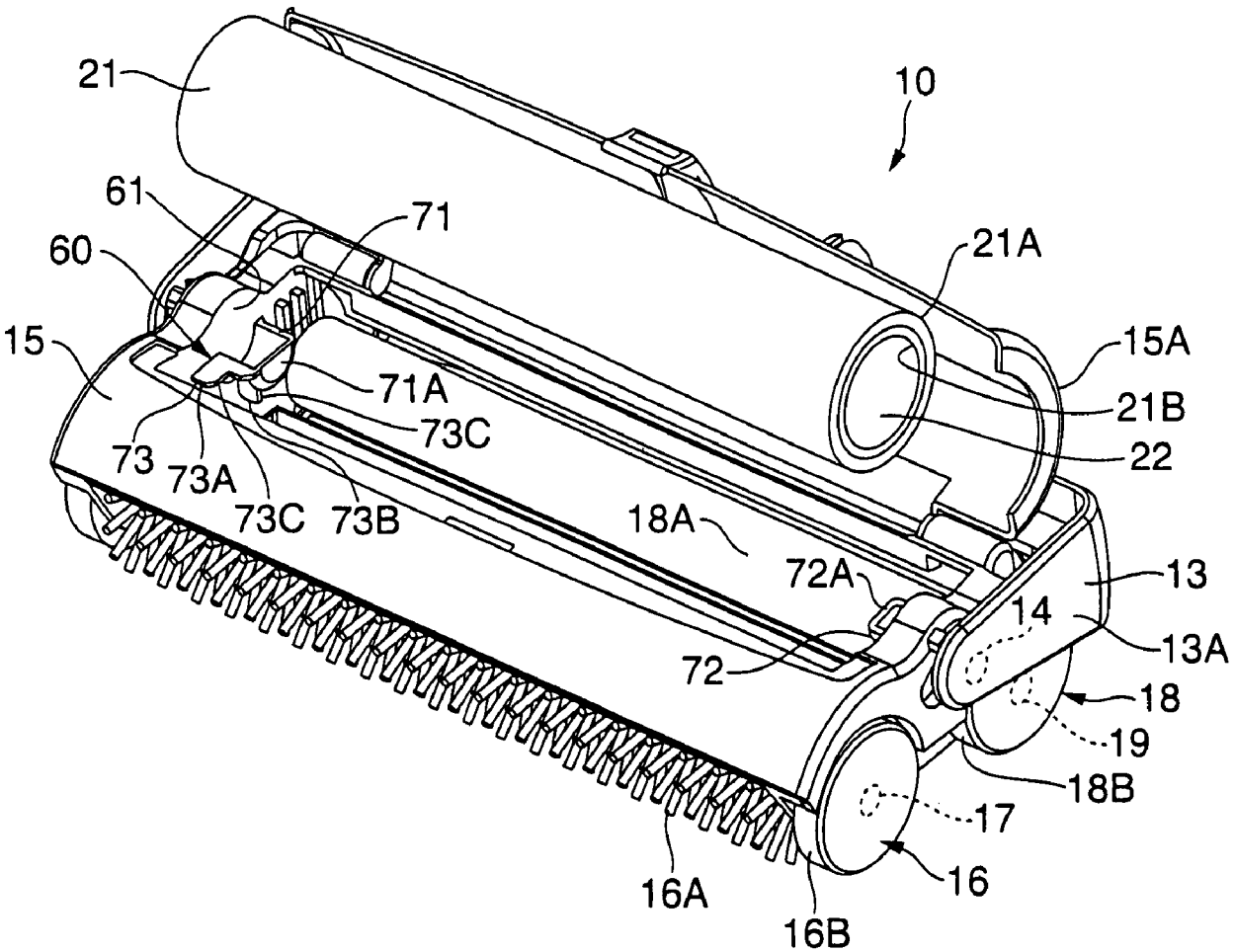
FIG. 5 is a perspective view showing the cleaning device.
Figure 6:
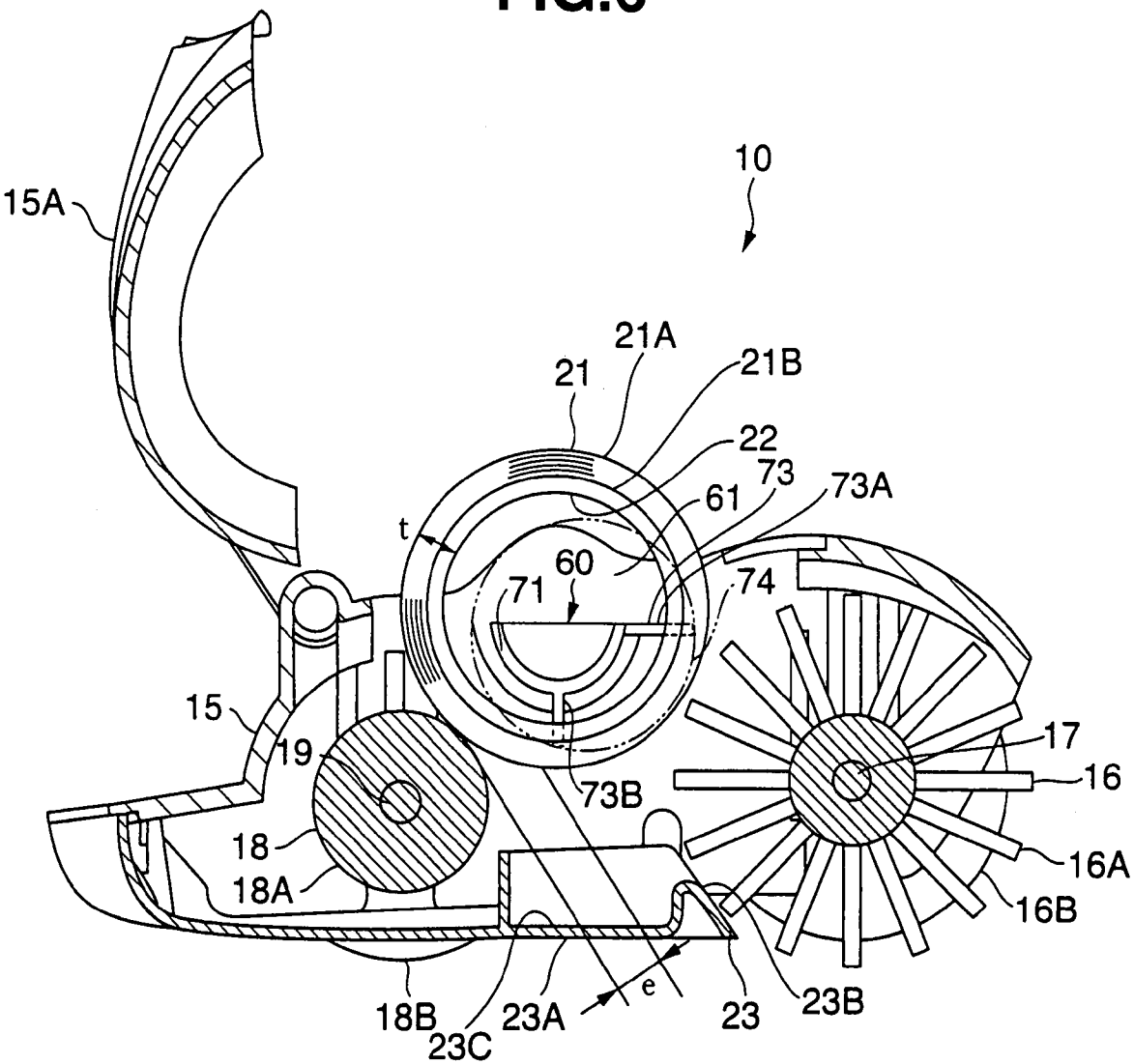
FIG. 6 is a horizontal cross sectional view showing the cleaning device.
Figure 7:
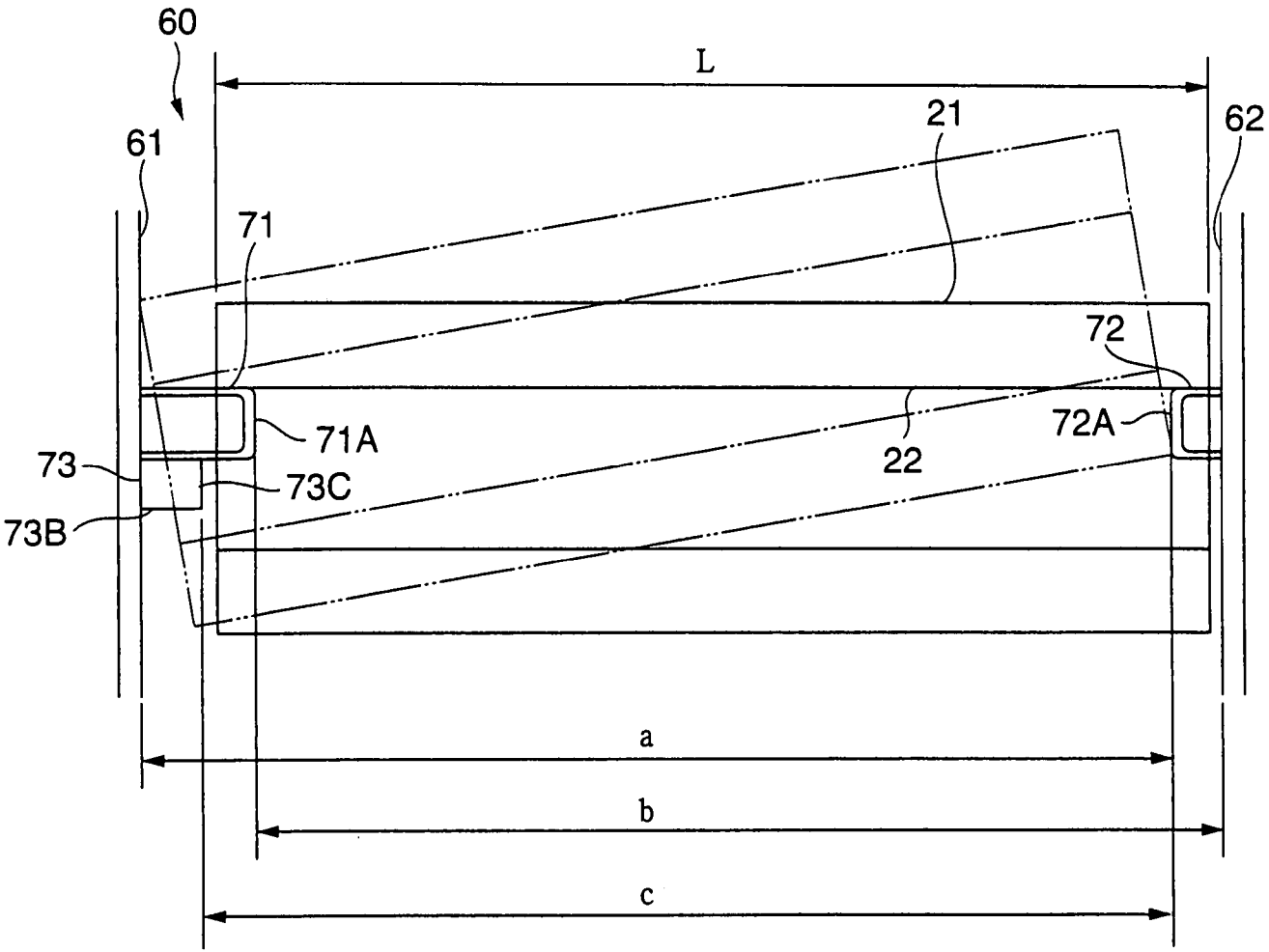
FIG. 7 is a schematic view showing a loaded state of an adhesive roll.

(Third Embodiment) (FIGS. 5 to 7)

In the cleaning device 10, a roll supporting apparatus 60 for the adhesive roll 21 is structured as follows.

The roll supporting apparatus 60 is provided with a first side wall 61 and a second side wall 62 opposing to the frame 15.

As shown in FIGS. 5 to 7, the roll supporting apparatus 60 is provided with a first projection 71 having a long protruding length in the first side wall 61, and is provided with a second projection 72 having a short protruding length in the second side wall 62. Both projections 71 and 72 are formed in a half cylindrical shape, and a tube surface thereof is arranged downward. A distance a from the first side wall 61 to a leading end surface 72A of the second projection 72 is set longer than a length L of the adhesive roll 21 (a>L), and a distance b from the second side wall 62 to a leading end surface 71A of the first projection 71 is set shorter than the length L of the adhesive roll 21 (L>b). Accordingly, the adhesive roll 21 is inclined (two-dot chain line in FIG. 7), one end of the hollow portion 22 in the adhesive roll 21 is inserted to the innermost recesses of the first projection 71, and thereafter, another end of the hollow portion 22 in the adhesive roll 21 is located at the front surface of the second projection 72 without being interfered with the second projection 72. In this state, another end of the hollow portion 22 is inserted into the second projection 72 by moving the adhesive roll 21 to the side of the second projection 72, whereby the adhesive roll 21 can be supported by both projections 71 and 72. The adhesive roll 21 is put on the scraping up body 18 and the contact rotating body 18 in a downward direction in this supported state by both projections 71 and 72, and is supported by both projections 71 and 72 in an upward direction.

As shown in FIG. 7, the roll supporting apparatus 60 is provided with a control projection 73 in a part in the peripheral direction of a base portion in the innermost recesses of the first projection 71, and in a part in the side facing to the scraping up body 16 in the present embodiment. In the present embodiment, the control projection 73 is constituted by two ribs 73A and 73B which are apart from each other in the peripheral direction of the first projection 71, however, the control projection 73 may be structured by expanding a part in the peripheral direction of the first projection 71. A distance c from the leading end surface 72A of the second projection 72 to the control projection 73 is made shorter than the length L of the adhesive roll 21 (L>c). Accordingly, one end surface of the adhesive roll 21 supported by both projections 71 and 72 can be brought into contact with and aligned with a leading end surface 73C of the control projection 73 so as to be opposed thereto, another end of the hollow portion 22 of the adhesive roll 21 controls the movement in a length direction for coming off from the second projection 72, and it is possible to prevent the adhesive roll 21 from dropping out from both projections 71 and 72.

In this case, in an end elevational view of the first projection 71 (FIG. 6), in the case of setting a diameter of a circumscribing circle 74 between the first projection 71 and the control projection 73 (the ribs 73A and 73B) to D, setting an inner diameter of the hollow portion 22 of the adhesive roll 21 to d, and setting a relation d>D, one end of the hollow portion 22 of the adhesive roll 21 can be inserted into the innermost recesses of the first projection 71, at a time of attaching and detaching the adhesive roll 21 as mentioned above. Further, in the end elevational view of the first projection 71 (FIG. 6), in the case of setting an interval formed by the circumscribing circle 74 between the first projection 71 and the control projection 73 with respect to the contact rotating body 18 to e, setting a thickness of the adhesive roll 21 to t, and setting a relation e>t, the adhesive roll 21 can be inserted into the first projection 71 without interfering with the contact rotating body 18, at a time of attaching and detaching the adhesive roll 21 as mentioned above.

The roll supporting apparatus 60 is structured, in the present embodiment, such that the control projection 73 is provided on the side facing to the scraping up body 16, and the scraping up body 16 is formed as an adhesive roll pressing means. The scraping up body 16 brings the brush into pressure contact with the surface of the adhesive roll 21 supported by both projections 71 and 72 in an elastically deflected state so as to press the adhesive roll 21 in a direction in which one end surface of the adhesive roll 21 opposes to the leading end surface 73C of the control projection 73. Accordingly, one end surface of the adhesive roll 21 is stably opposed to the leading end surface 73C of the control projection 73 so as to be collided and aligned therewith.

According to the present embodiment, the following effects can be obtained.

(1) Since the structure is made such that the adhesive roll 21 is supported by both projections 71 and 72 according to a simple hooking manner by inserting another end of the hollow portion 22 of the adhesive roll 21 to the second projection 72 after inserting one end of the hollow portion 22 of the adhesive roll 21 to the first projection 71, both projections 71 and 72 corresponding to the means for supporting the adhesive roll 21 are formed as a fixed structure, and no special movable parts are provided, it is possible to simplify the structure, it is possible to improve its durability and it is possible to improve the workability of attaching and detaching the adhesive roll 21.

(2) The movement of the adhesive roll 21 in the length direction is limited by opposing one end surface of the adhesive roll 21 supported by both projections 71 and 72 to the leading end surface 73C of the control projection 73 so as to allow the collision and alignment, and one end of the hollow portion 22 of the adhesive roll 21 moves to a base portion of the first projection 71 so as to prevent another end of the hollow portion 22 of the adhesive roll 21 from coming off from the second projection 72. In other words, it is possible to prevent the adhesive roll 21 from dropping out from both projections 71 and 72, and the adhesive roll 21 is stably supported in a rotatable state without coming off.

(3) Based on item (1) mentioned above, it is possible to easily replace the adhesive roll 21, and based on item (2) mentioned above, it is possible to easily release and remove the used portion of the adhesive sheet while keeping a state in which the adhesive roll 21 is stably supported.

(4) In a normal loaded state of the adhesive roll 21, one end surface of the adhesive roll 21 can be securely opposed to the leading end surface 73C of the control projection 73 so as to achieve the collision and alignment, by pressing the adhesive roll 21 by the brush (the roll pressing means) of the scraping up body 16 in a direction in which one end surface of the adhesive roll is going to oppose to the leading end surface 73C of the control projection 73, and it is possible to securely achieve the come-off prevention of the adhesive roll 21 based on item (2) mentioned above.

(5) In this case, when pressure moving the adhesive roll 21 to the brush against the pressing force of the brush described in item (4) mentioned above, the moving limit of the adhesive roll 21 achieved by the control projection 73 is cancelled, one end of the adhesive roll 21 can be moved to the base portion of the first projection 71, and another end of the hollow portion 22 of the adhesive roll 21 can be detached from the second projection 72, so that it is possible to detach the adhesive roll 21 from both projections 71 and 72.

Figure 8:
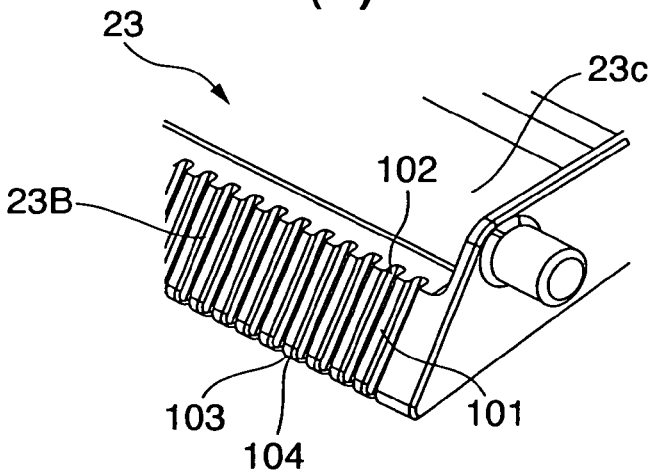
FIG. 8 is a schematic view showing a scooping surface portion of the dustpan portion.
Figure 8:
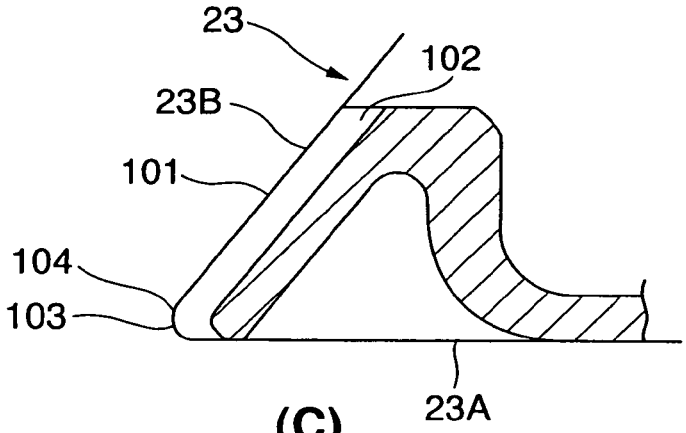
Figure 8:
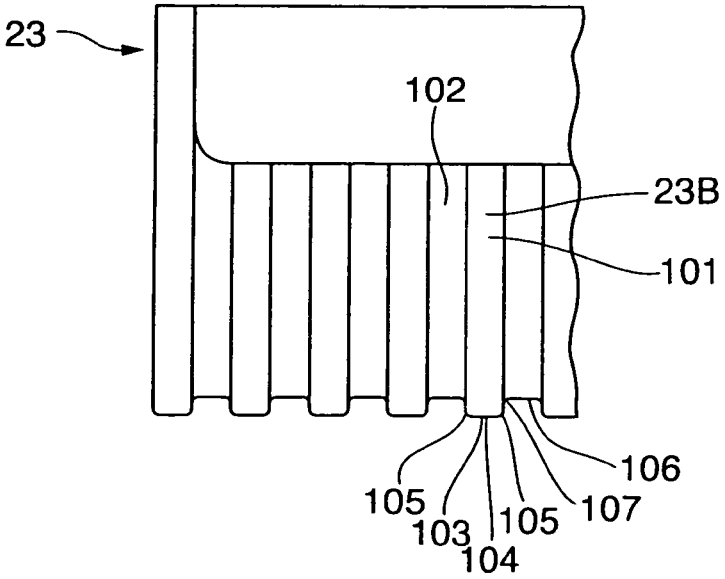
Figure 9:
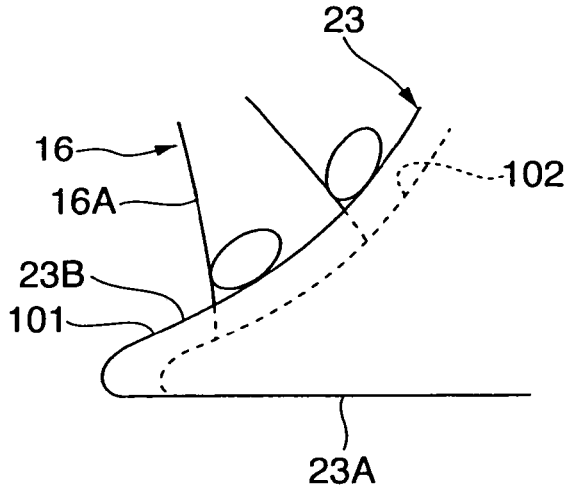
FIG. 9 is a schematic view showing a state in which dust is scraped up by a scraping up body.
Figure 9:
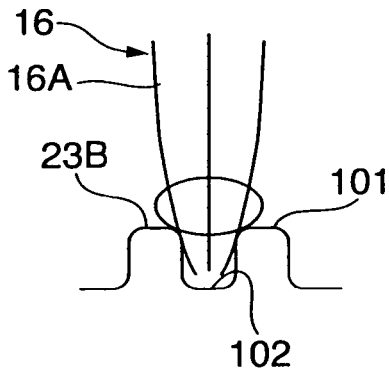
Figure 9:
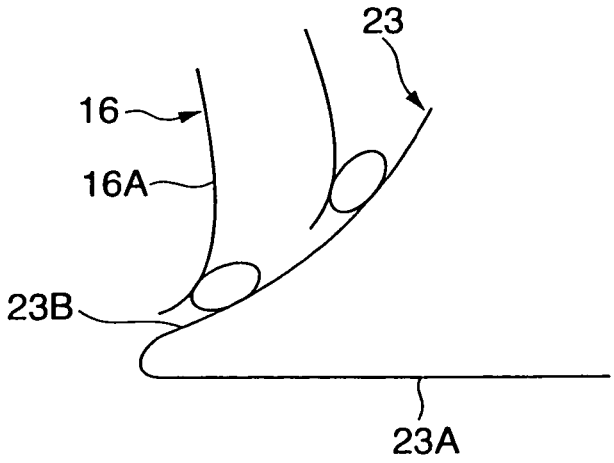
Figure 10:
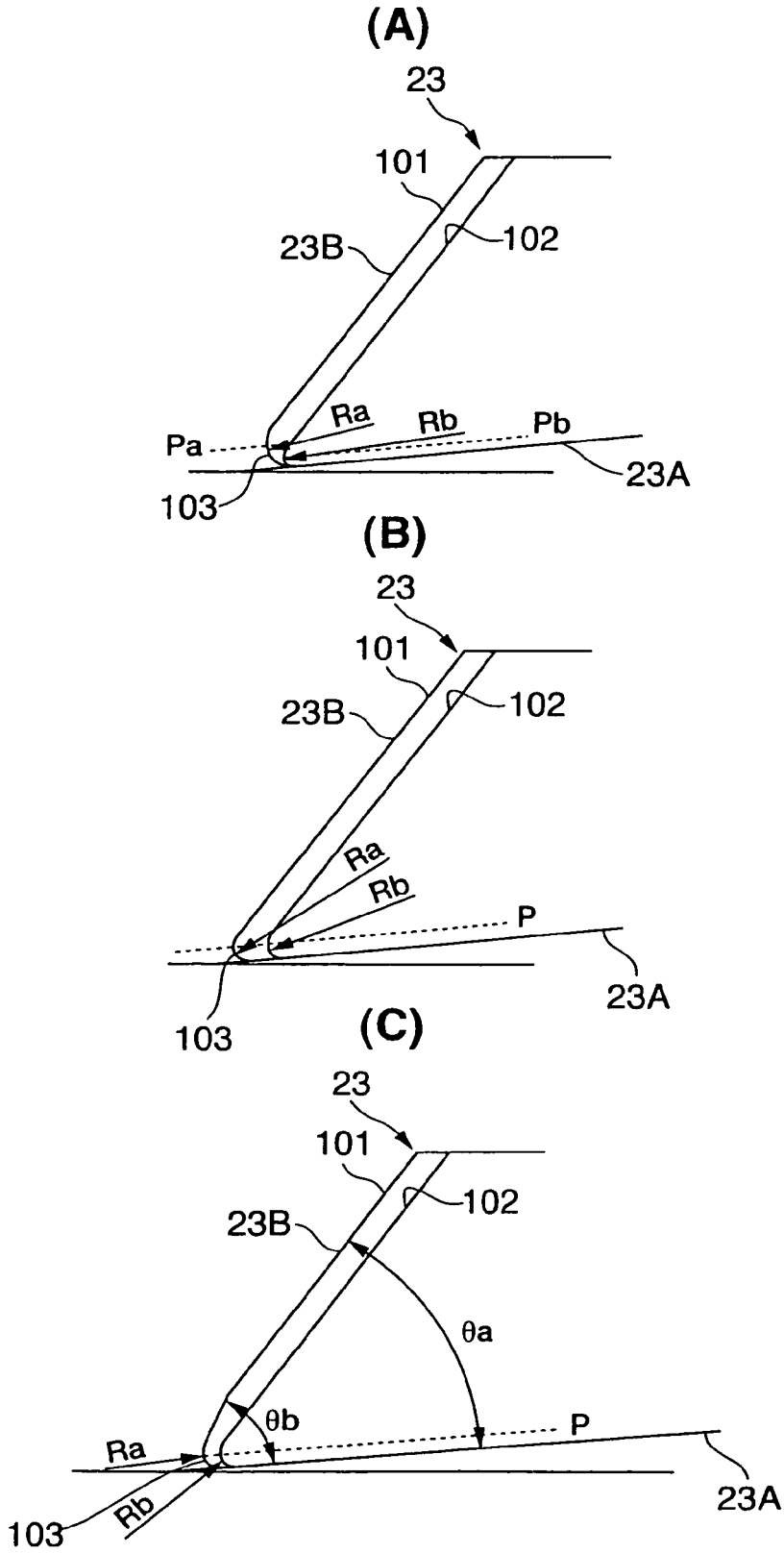
FIG. 10 is a schematic view showing a leading end shape of the scooping surface portion of the dustpan portion.

(Fourth Embodiment) (FIGS. 8 to 10)

In the cleaning device 10, as shown in FIGS. 8 and 9, the scooping surface portion 23B of the dustpan portion 23 is provided with a plurality of convex portions 101 extending along a scraping up direction of the scraping up body 16, and a plurality of grooves 102 formed between the adjacent convex portions 101.

Further, the scooping surface portion 23B of the dustpan portion 23 is structured such that the leading ends of a plurality of convex portions 101 are extended to the bottom surface portion 23A, so that an edge 103 on the floor surface side of the scooping surface portion 23B of the dustpan portion 23 is provided with a concavo-convex tooth surface 104 extending along a width direction of the edge 103. Further, an R surface (a curved surface), for example, having a radius of about 0.3 mm is applied to both side corner portions 105 in the leading end of the convex portion 101 forming the concavo-convex tooth surface 104, in the plan view (FIG. 8(C)) of the scooping surface portion 23B of the dustpan portion 23, and an R surface, for example, having a radius of about 0.3 mm is applied to both side corner portions 107 of a recess portion 106, thereby preventing the concavo-convex tooth surface 104 from being caught on the carpet on the floor surface by both side corner portions 105.

In this case, aspects in FIGS. 10(A) to 10(C) can be employed for the leading end shape of the scooping surface portion 23B of the dustpan portion 23, in view of the design of a metal mold for forming the dustpan portion 23.

(Embodiment 1) (FIG. 10(A))

When making a leading end Ra (a radius of circle) of the convex portion 101 larger than a leading end Rb of the groove 102, the carpet is less frequently caught on. Specifically, the leading end Ra is set to 0.8 mm, and the leading end Rb of the groove 102 is set to 0.3 mm. The dust can be easily scraped up by making the leading end Rb smaller than the leading end Ra. At this time, a parting line of the metal mold for molding the dustpan portion 23 is provided in the protruding ends of the leading ends Ra and Rb so as to prevent an undercut from being generated, however, since the leading ends Ra and Rb are different, a step is formed between a parting line Pa passing through the protruding end of the leading end Ra and a parting line Pb passing through the protruding end of the leading end Rb, and the metal mold is complex.

(Embodiment 2) (FIG. 10(B))

The step of the parting line P is lost by setting the leading end Ra of the convex portion 101 and the leading end Rb of the groove 102 to the same 0.5 mm, whereby the metal mold is made simple. However, a protruding amount (about 1 mm) of the leading end of the convex portion 101 with respect to the leading end of the groove 102 becomes excessive, and there is a possibility that the edge 103 of the scooping surface portion 23B is slightly caught on the carpet.

(Embodiment 3) (FIG. 10(C))

The step of the parting line P is lost by setting the leading end Ra of the convex portion 101 and the leading end Rb of the groove 102 to the same 0.5 mm, whereby the metal mold is made simple. Further, the protruding amount (0.4 mm) of the leading end of the convex portion 101 with respect to the leading end of the groove 102 is made smaller by making an angle of incline θb (for example, 65 degrees) of the leading end side of the convex portion 101 with respect to the bottom surface portion 23A larger than an angle of incline θa (for example, 50 degrees) of the other portions than the leading end side of the convex portion 101 with respect to the bottom surface portion 23A, whereby the carpet is inhibited from being caught by the edge 103 of the scooping surface portion 23B.

According to the present embodiment, the following effects can be obtained.

(1) When the brush constituting the scraping up body 16 is in slidable contact with the scooping surface portion 23B of the dustpan portion 23 so as to scrape up the dust, as shown in FIGS. 9(A) and 9(B), the leading end of the brush comes into the groove 102 of the scooping surface portion 23B, the dust is scraped up with being supported by the body of the brush, the dust do not drop out from the leading end of the brush, and it is possible to reduce the occurrence of failing to pick up dust.

(2) When the scraping up body 16 plunges into the fibers of the carpet so as to scrape up against the rubber, the edge 103 on the floor surface side of the scooping surface portion 23B of the dustpan portion 23 forms the concavo-convex tooth surface 104, the convex tooth surface of the edge 103 forward pushes the way among the fibers of the carpet, the resistance against the forward movement is small, and it is possible to lighten the forward movement handling force of the cleaning device 10.

(3) Both the dust scraped up from the thick-piled part of the carpet by the scraping up body 16, and the dust scraped up rearward from the hard flat surface of the flooring, can be scraped up to the dustpan portion 23 in the rear portion of the scraping up body 16 so as to be securely guided to the side of the adhesive roll 21, and are securely adhered and picked up by the adhesive surface of the adhesive roll 21, whereby it is possible to improve dust collecting performance.

Figure 11:
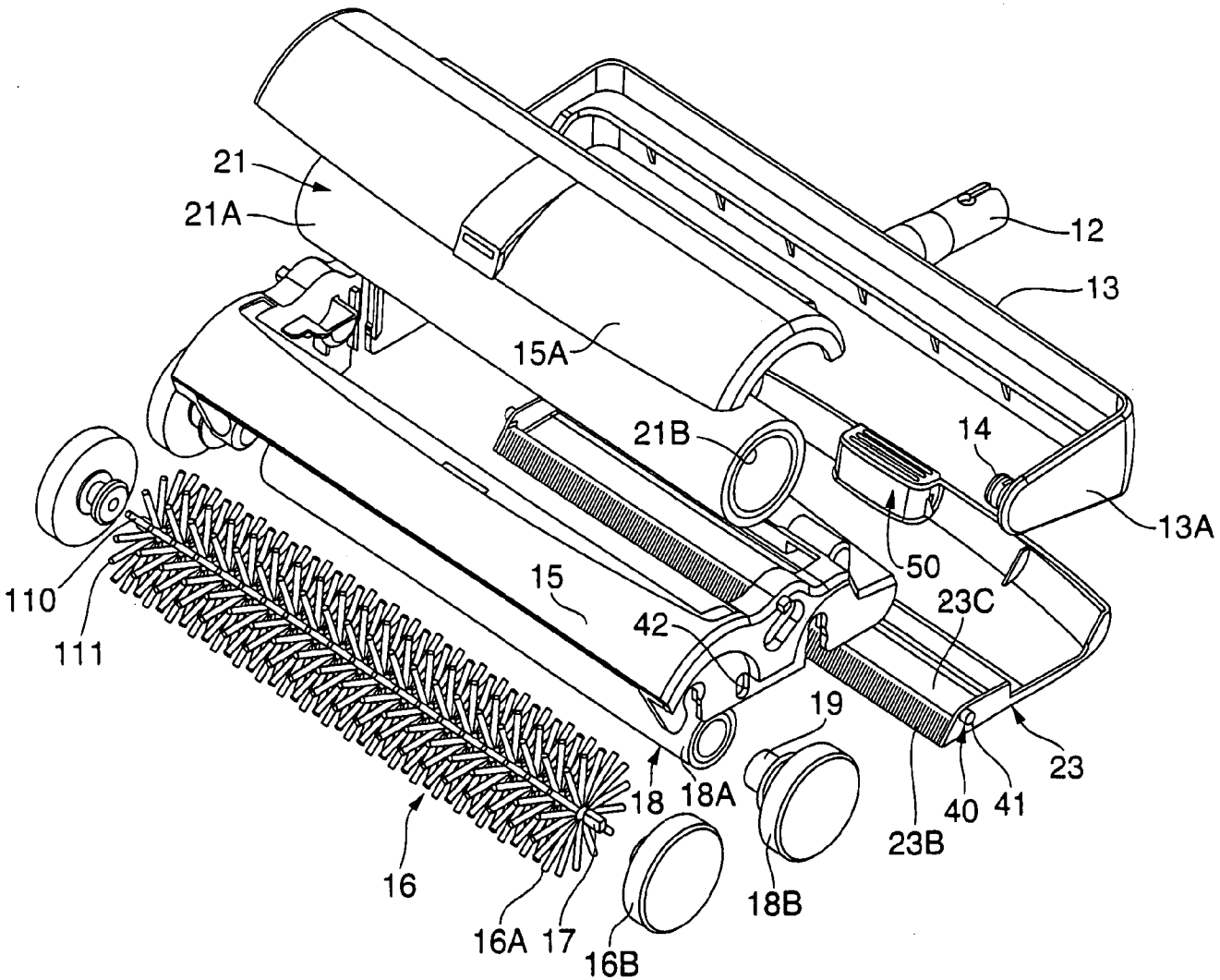
FIG. 11 is an exploded perspective view of the cleaning device.

(Fifth Embodiment) (FIG. 11)

The scraping up body 16 of the cleaning device 10 is structured such that the roll-shaped scraping up body is formed around, for example, two core wires 110, by holding each of the center portions of a plurality of fiber members 111 having the same length between the core wires 110, and twisting the core wires 110 so as to fix the fiber members 111.

In this case, the fiber members 111 of the scraping up portion 16A constituting the scraping up body 16 is necessarily provided with a bending elastic property which can satisfy the following conditions.

(1) The fiber members 111 can elastically deflect based on a control force applied to the handle 11 so as to bring the tire portion 16B into contact with the floor surface, and can elastically restore in such a manner as to scrape up the dust on the floor surface together with the rotation of the tire portion 16B, and (2) the fiber members 111 can generate a bending elastic force (for example, 200 gf) capable of supporting the weight of the adhesive roll 21.

Further, in the scraping up portion 16A constituting the scraping up body 16, the fiber members 111 having different bending elastic properties are mixed. Specifically, the thick fiber members 111 and the thin fiber members 111 made of the same raw material are mixed, and more specifically, pig bristles are employed as the fiber members 111.

The scraping up body 16 according to the present embodiment is structured such that the diameter of the scraping up portion 16A is set to 40 mm, the diameter of the tire portion 16B is set to 34 mm, and the fiber members 111 made of the pig bristles employ the various fiber members 111 in a range between. the thin fiber members 111, for example, having a thickness (diameter) of 0.05 mm and the thick fiber members 111, for example, having a thickness (diameter) of 0.3 mm. Further, the density of fiber implant of the fiber members 111 per a unit axial length (1 mm) of the scraping up portion 16A, and all around the periphery is between 25 and 35 per mm, and more preferably 30 per mm.

According to the present embodiment, the following effects can be obtained.

(1) Since the brush constituting the scraping up body 16 is formed by mixing the fiber members 111 having different bending elastic properties, the motion of each of the fiber members 111 at a time when the scraping up body 16 rolls on the floor surface varies. Accordingly, the forward movement handling feeling of the cleaning device 10 is lithe, and the cleaning device 10 is excellent in continuity of the scraping up operation by the scraping up body 16.

(2) Since the scraping up body 16 is provided with the fiber members 111 having a strong bending elasticity and the fiber members 111 having a weak bending elasticity in a mixed manner, it is possible to scrape up the larger dust by the fiber members 111 having the strong bending elasticity, and scrape up the smaller dust by the fibers 111 having the weak bending elasticity, whereby it is possible to scrape up all the dust.

(3) Since the scraping up body 16 is constituted by mixing the thick fiber members 111 (having the strong bending elasticity) and the thin fiber members 111 (having the weak bending elasticity), it is possible to mix the fiber members 111 having the different bending elastic properties while employing the same material fiber members 111, and it is possible to achieve items (1) and (2).

(4) Since the scraping up body 16 employs the fiber members 111 constituted by the pig bristles, it is possible to easily mix the thick fiber members 111 and the thin fiber members 111, in other words, it is possible to easily mix the fiber members 111 having the different bending elastic properties, and it is possible to achieve items (1) and (2) mentioned above.

(5) The pig bristles generate less static electricity as compared with synthetic fiber. Accordingly, it is possible to easily avoid the electrostatic attachment of the dust to the scraping up body 16.

(6) The pig bristles deform less, and any temporary deformation can be solved by applying humidity. Accordingly, even when resting the cleaning device 10 on the floor surface for a long time, the brush constituting the scraping up body 16 is difficult to deform, and it is possible to obtain a stable scraping up performance.

Figure 12:
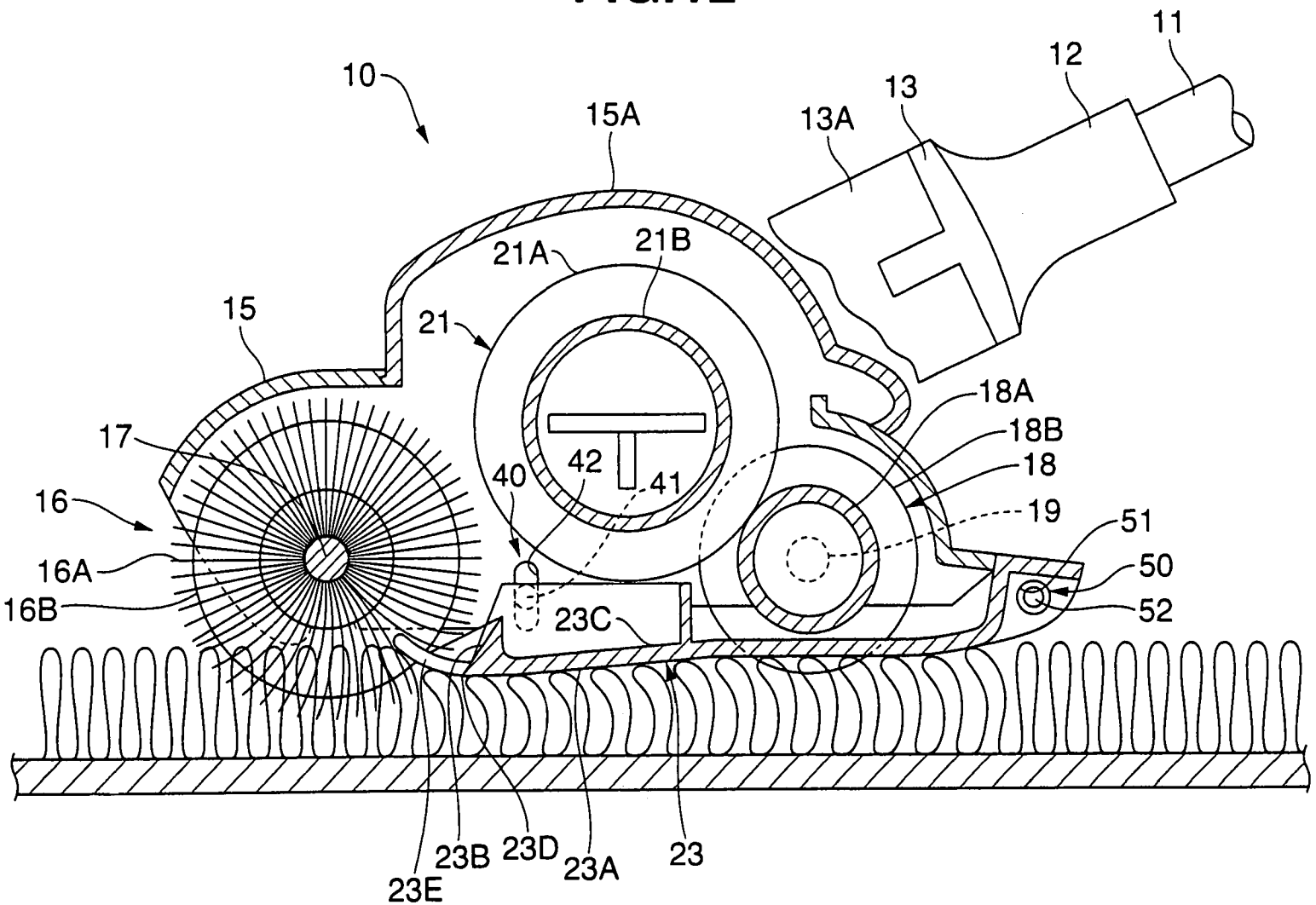
FIG. 12 is a side elevational view showing the cleaning device.
Figure 13:
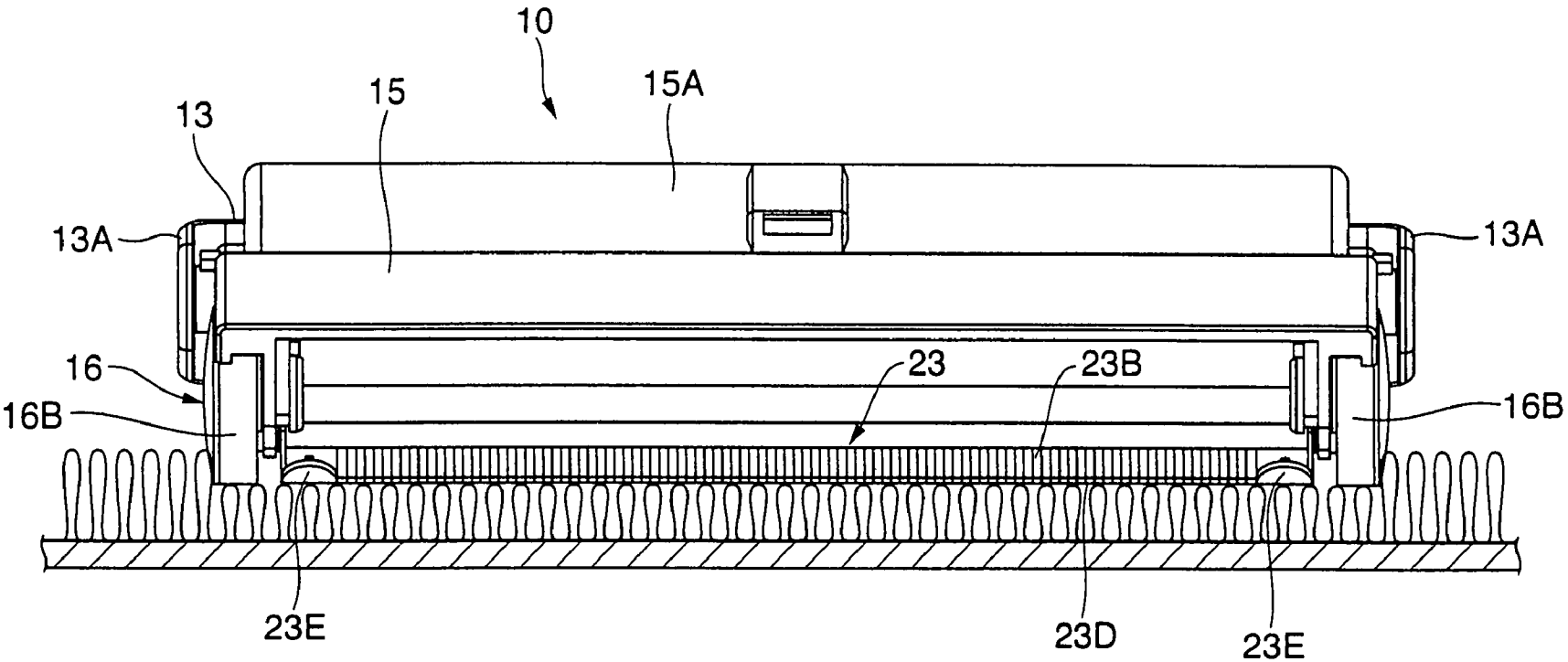
FIG. 13 is a front elevational view of FIG. 12.
Figure 14:
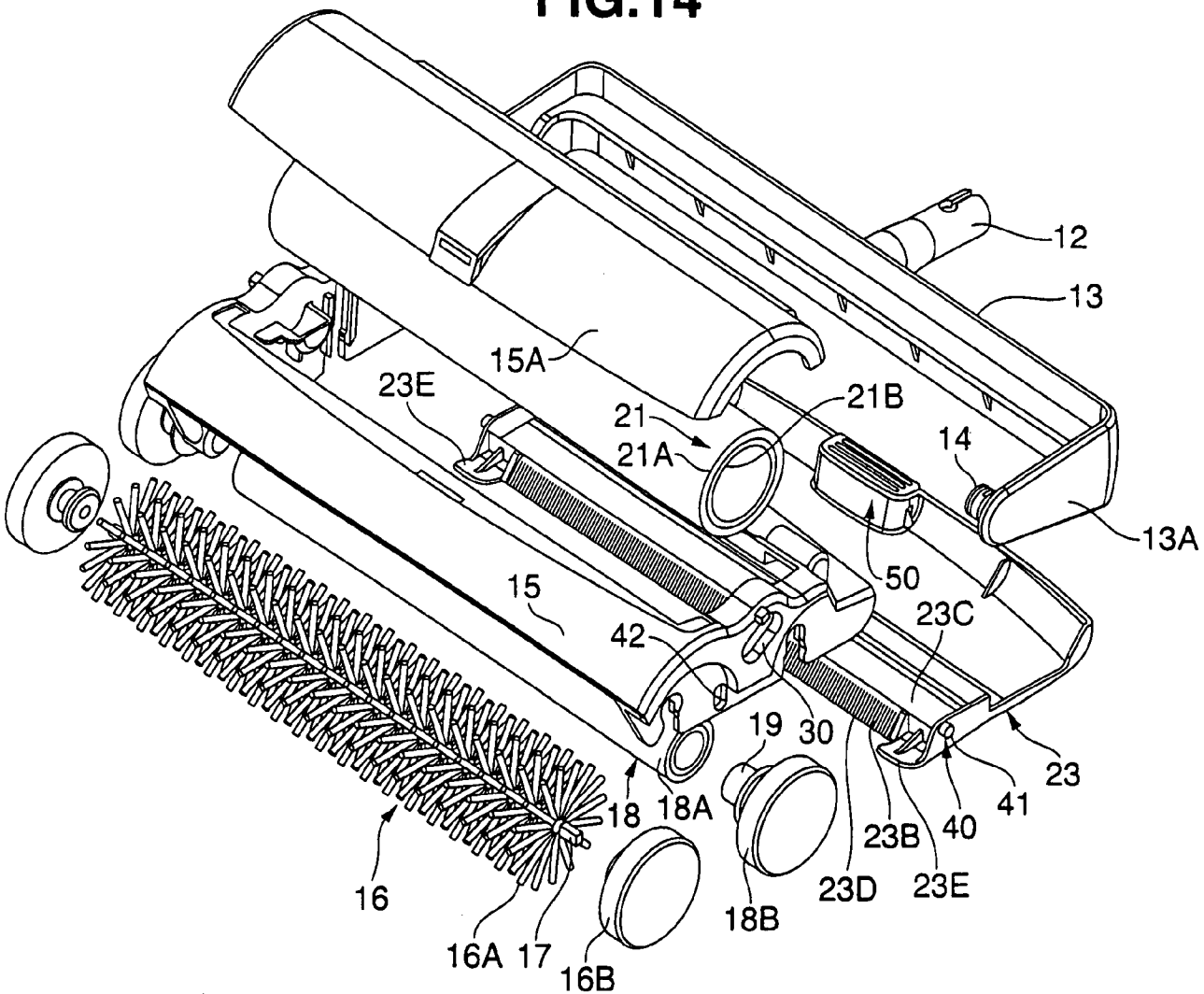
FIG. 14 is an exploded perspective view of the cleaning device.

(Sixth Embodiment) (FIGS. 12 to 14)

Further, the cleaning device 10 according to the sixth embodiment is provided with warping-shaped guide shoes 23E warping up to a front upper side with respect to the floor surface, in both ends of the front edge 23D of the dustpan portion 23. In this case, the guide shoe 23E is in surface contact with the floor surface, and has no scooping surface portion 23B. In the front edge 23D of the dustpan portion 23, the portion clamped by the guide shoes 23E on both ends forms an edge (a lowermost end portion) on the floor surface side of the scooping surface portion 23B, and is slidably in contact with the floor surface of the flooring and the tatami mat with no gap.

Therefore, according to the cleaning device 10 mentioned above, the following effects can be obtained.

(1) When the cleaning device 10 is used for thick-piled carpet, the guide shoes 23E at both ends of the dustpan portion 23 ride over the fibers of the carpet so as to float above even in the case of moving forward the scraping up body 16 in a state of pressing the scraping up body 16 to the fibers of the carpet in such a manner that the scraping up body 16 plunges into the fibers of the carpet so as to scrape up the dust, whereby it is possible to avoid the front edge 23D of the dustpan portion 23 from sticking into the fibers of the carpet so as to generate resistance against the forward movement, and an improved operability can be achieved due to a smooth forward movement.

(2) The dustpan portion 23 is structured such that only both ends of the front edge 23D are formed as the guide shoes 23E warping up with respect to the floor surface, and the portion clamped by the guide shoes 23E of the front edge 23D is in contact with the floor surface with no gap. Accordingly, even when cleaning the flooring and the tatami mat other than carpet, the front edge 23D of the dustpan portion 23 is in contact with the floor surface with no gap, the scraping up portion 16A of the scraping up body 16 can pick up all the dust without letting out the dust scraped up by the scraping up portion 16A toward the rear side along the floor surface.

(Seventh Embodiment) (FIGS. 15 to 19)

Further, the cleaning device 10 according to the seventh embodiment is structured such that the scraping up body 16 is constituted by a supporting shaft 121, the scraping up portion 16A comprising a brush implanted along an entire length of the supporting shaft 121 in an axial direction, and both side tire portions 16B connected to both end portions of the supporting shaft 121, and the rotational shaft 17 mentioned above is provided in the tire portions 16B. The scraping up portion 16A may be either in contact with the adhesive roll 21 or in non-contact with the adhesive roll 21. Both side tire portions 16B are arranged in both outer sides of the frame 15.

The rotating body 18 is constituted by a supporting shaft 131, a disc-shaped rotating element 18A fixed to both end side positions in an axial direction of the supporting shaft 131 (a plurality of positions such as three positions or the like in the axial direction may be employed), and both side tire portions 18B connected to both end portions of the supporting shaft 131, and the tire portion 18B is provided with the rotational shaft 19 mentioned above. The rotating element 18A is in contact with the adhesive roll 21. Both side tire portions 18B are arranged on both outer sides of the frame 15.

Further, the dustpan portion 23 has the bottom surface portion 23A being in contact with the floor surface, and the curved (or flat) scooping surface portion 23B faces to the scraping up body 16 with no gap (or via a gap), and a recessed dust receiving portion 23C extends to a range extending forward and backward of the lower side of the rotating element 18A in the rotating body 18.

In the cleaning device 10, as mentioned above, since the rotating body 18 is constituted by the supporting shaft 131 and the rotating element 18A, the following structures (a) and (b) are provided. In this case, the supporting shaft 131 and the rotating element 18A of the rotating body 18 are arranged in a space held between the frame 15 and the dustpan portion 23.

Figure 16:
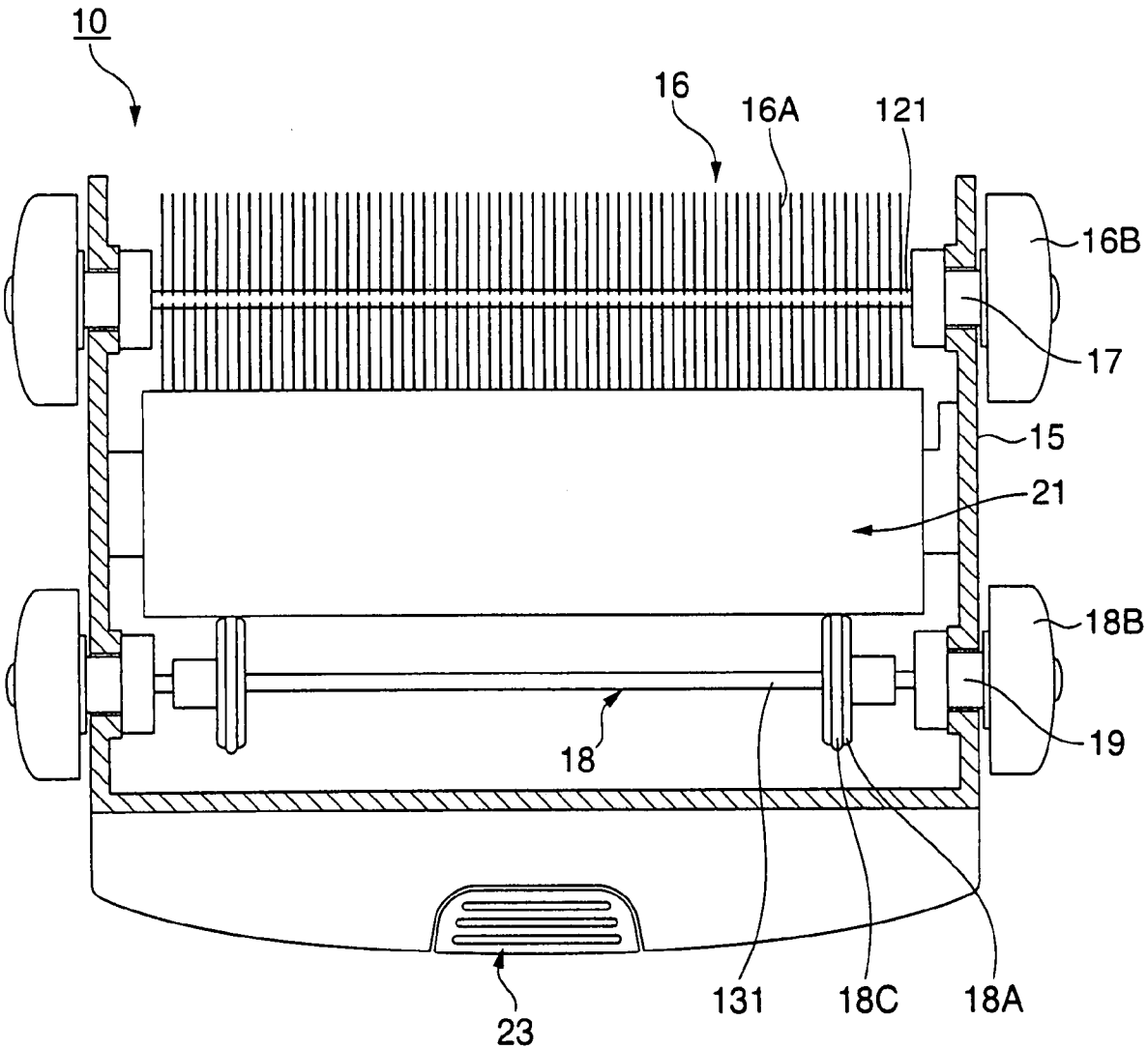
FIG. 16 is a schematic plan view showing the cleaning device.

(a) The supporting shaft 131 of the rotating body 18 is separated from the adhesive roll 21 via a large gap, at the portion to which the rotating element 18A is not fixed (FIG. 16).

Figure 15:
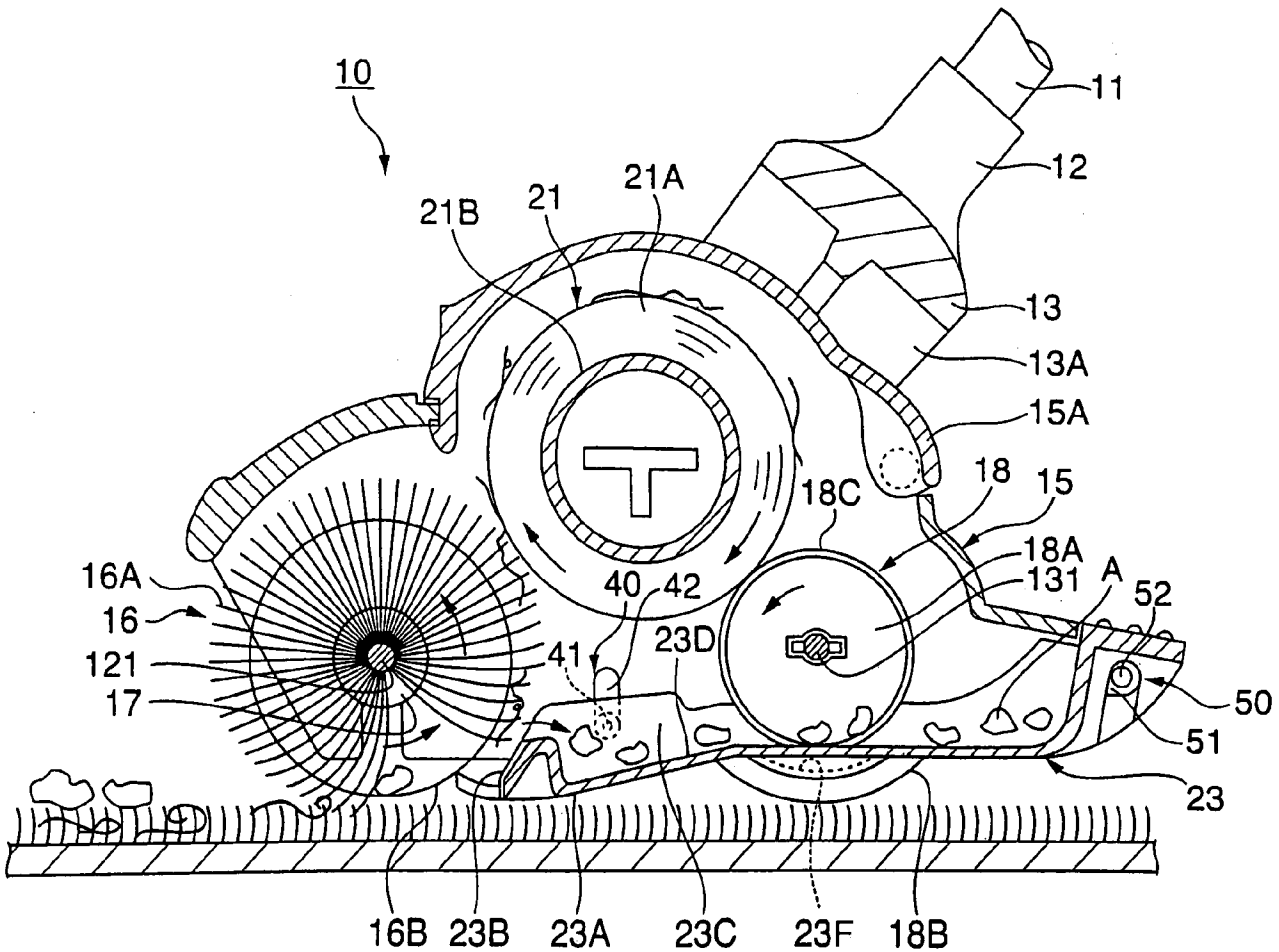
FIG. 15 is a schematic side elevational view showing the cleaning device.

(b) The supporting shaft 131 of the rotating body 18 is separated from the dustpan portion 23 (the bottom surface 23A of the dust receiving portion 23C) via a large gap, at the portion to which the rotating element 18A is not fixed (FIG. 15). In this case, at the bottom surface 23A of the dust receiving portion 23C, the portion corresponding to the rotating element 18A is formed as the circular arc recess portion 23F.

In this case, the rotating element 18A of the rotating body 18 is provided with an annular ring 18C such as a silicone rubber O-ring or the like in an outer periphery thereof The annular ring 18C is loaded to an annular groove provided on the rotating element 18A.

Figure 17:
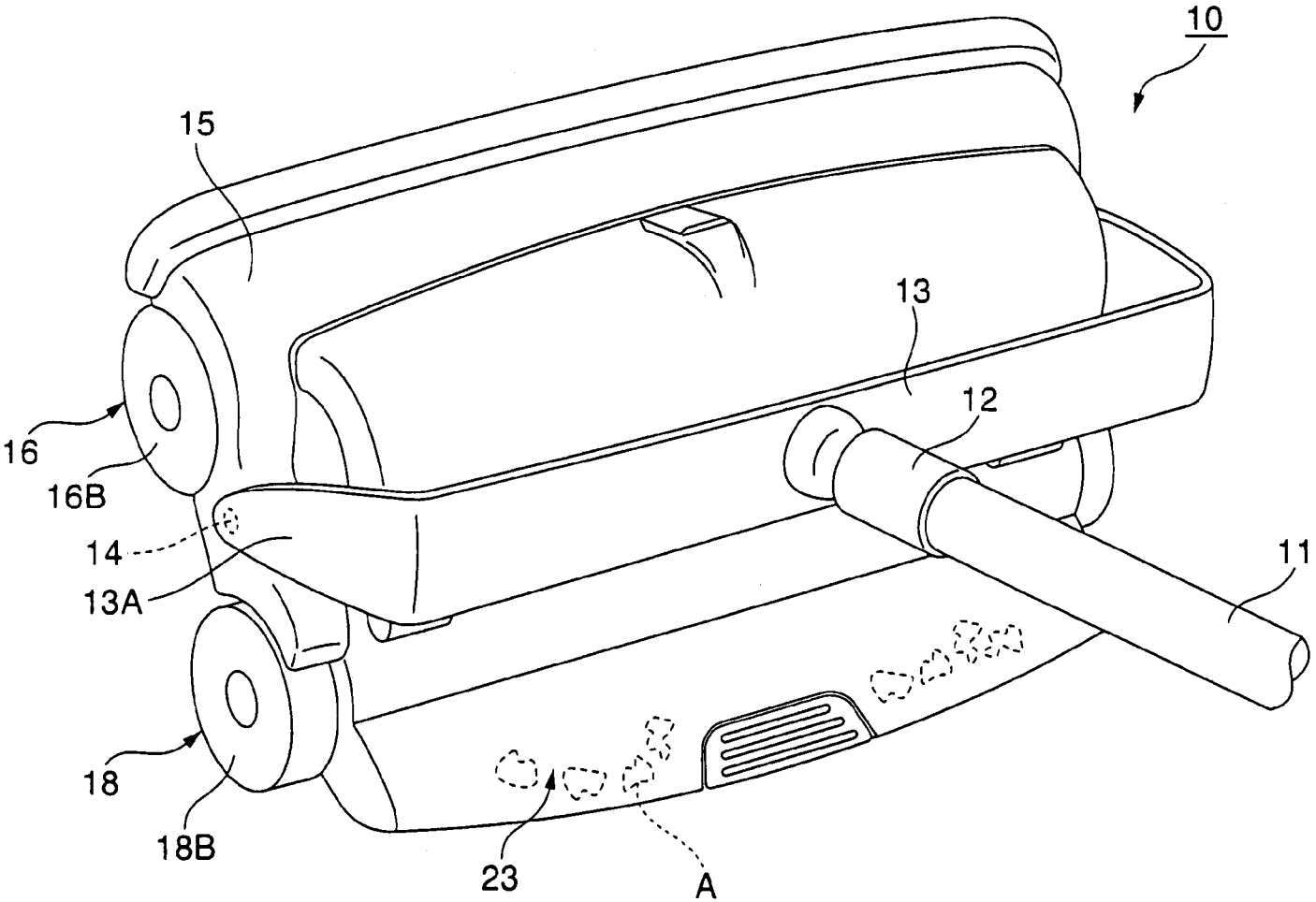
FIG. 17 is a perspective view showing an uplifted state of the cleaning device.
Figure 18:
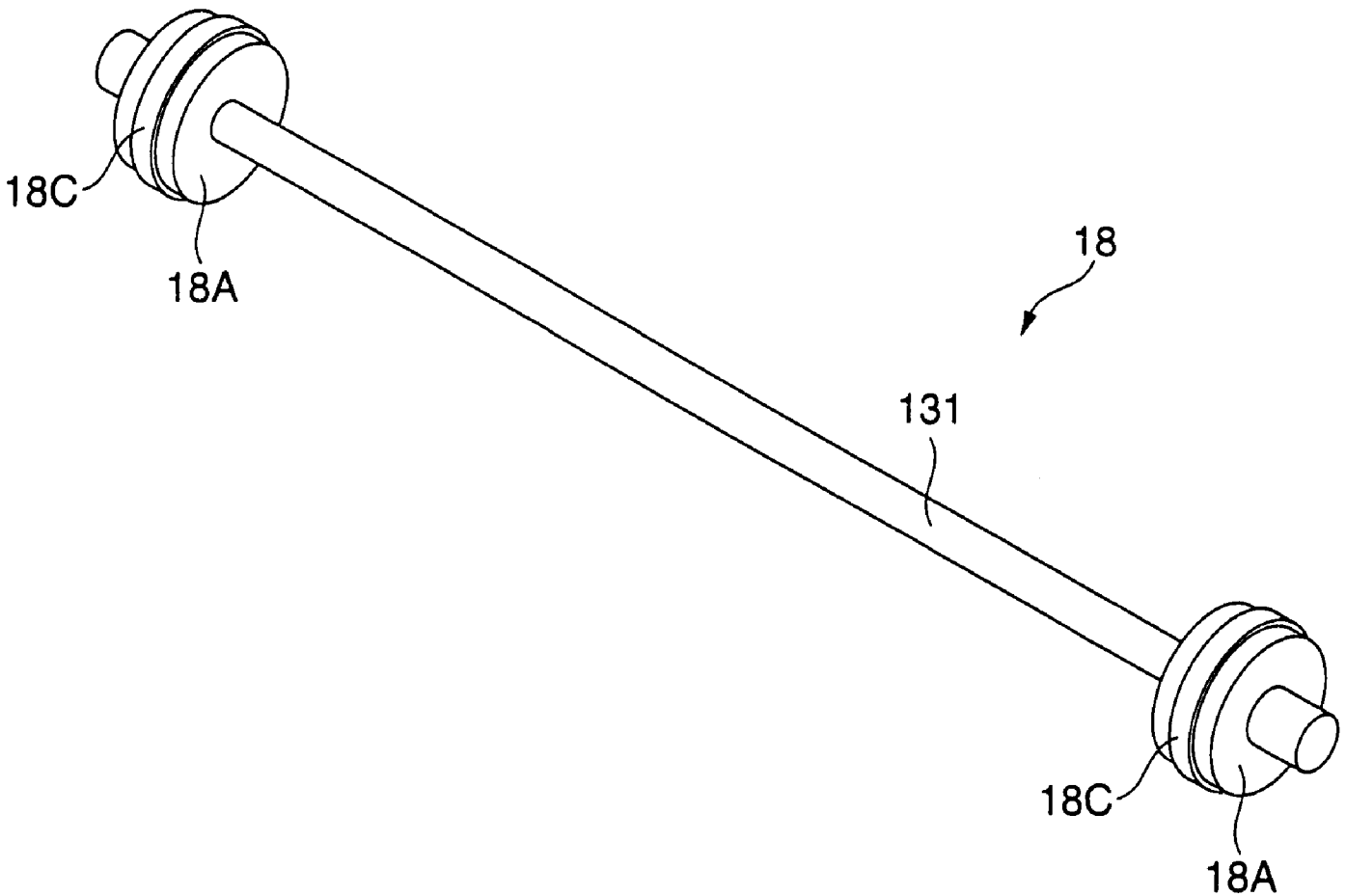
FIG. 18 is a perspective view showing a rotating body.

In this case, the cleaning device 10 positions the gravity point of the frame 15 and the mounting parts thereof around the supporting shaft portion 14 of the supporting arm 13 in such an inclined state that the scraping up body 16 is positioned in a front side and an upper side of the rotating body 18, as shown in FIG. 17, under a state in which the frame 15 is lifted up by the handle 11 and the supporting arm 13. At a time of replacing the adhesive roll 21 in the cleaning device 10, the dust A existing in the front side (close to the scraping up body 16) in the dust receiving portion 23C of the dustpan portion 23 moves to the rear side of the rotating body 18 of the dust receiving portion 23C through the lower side of the supporting shaft 131 of the rotating body 18, in the inclined state mentioned above in which the frame 15 is lifted up, and the dust can be visible from the outer side of the frame 15 and the dustpan portion 23 which are made of a transparent resin.

According to the present embodiment, the following effects can be obtained.

(1) The rotating body 18 is constituted by the supporting shaft 131 and the rotating element 18A, and the supporting shaft 131 is separated from the adhesive roll 21 in the portion to which the rotating element 18A is not fixed. Accordingly, even in the case that the large dust scraped up to the scraping up body 16 is attached to the adhesive roll 21, the dust passes through the large gap with respect to the supporting shaft 131 so as to rotate with the adhesive roll 21, and does not prevent the adhesive roll 21 from smoothly rotating. The large dust can be stably picked up by the adhesive roll 21.

(2) The supporting shaft 131 of the rotating body 18 is separated from the dustpan portion 23 at the portion to which the rotating element 18A is not fixed. Accordingly, in a wide range in an inner portion of the dustpan portion 23, the supporting shaft 131 forms a large gap with respect to the inner surface of the dustpan portion 23, and increases the dust intake capacity of the dustpan portion 23.

(3) The dust scraped up by the scraping up body 16 and delivered to the dustpan portion 23, can smoothly pass through the large gap in the lower side of the supporting shaft 131 of the rotating body 18 from the front side (the side close to the scraping up body 16) of the rotating body 18 of the dustpan portion 23, based on the incline formed by lifting up the side of the scraping up body 16 of the cleaning device 10, and can move to the rear side of the rotating body 18 of the dustpan portion 23. The dust moves to the rear side of the dustpan portion 23 which is not shielded by the scraping up body 16, the rotating body 18 and the adhesive roll 21, and it is possible to improve the visibility of the dust accumulating state by the user. Further, since the dust is moved to the rear side of the rotating body 18 of the dustpan portion 23, the dust coming into the dustpan portion 23 does not drop out from the scooping surface portion 23B corresponding to the intake port of the dustpan portion 23.

Figure 19:
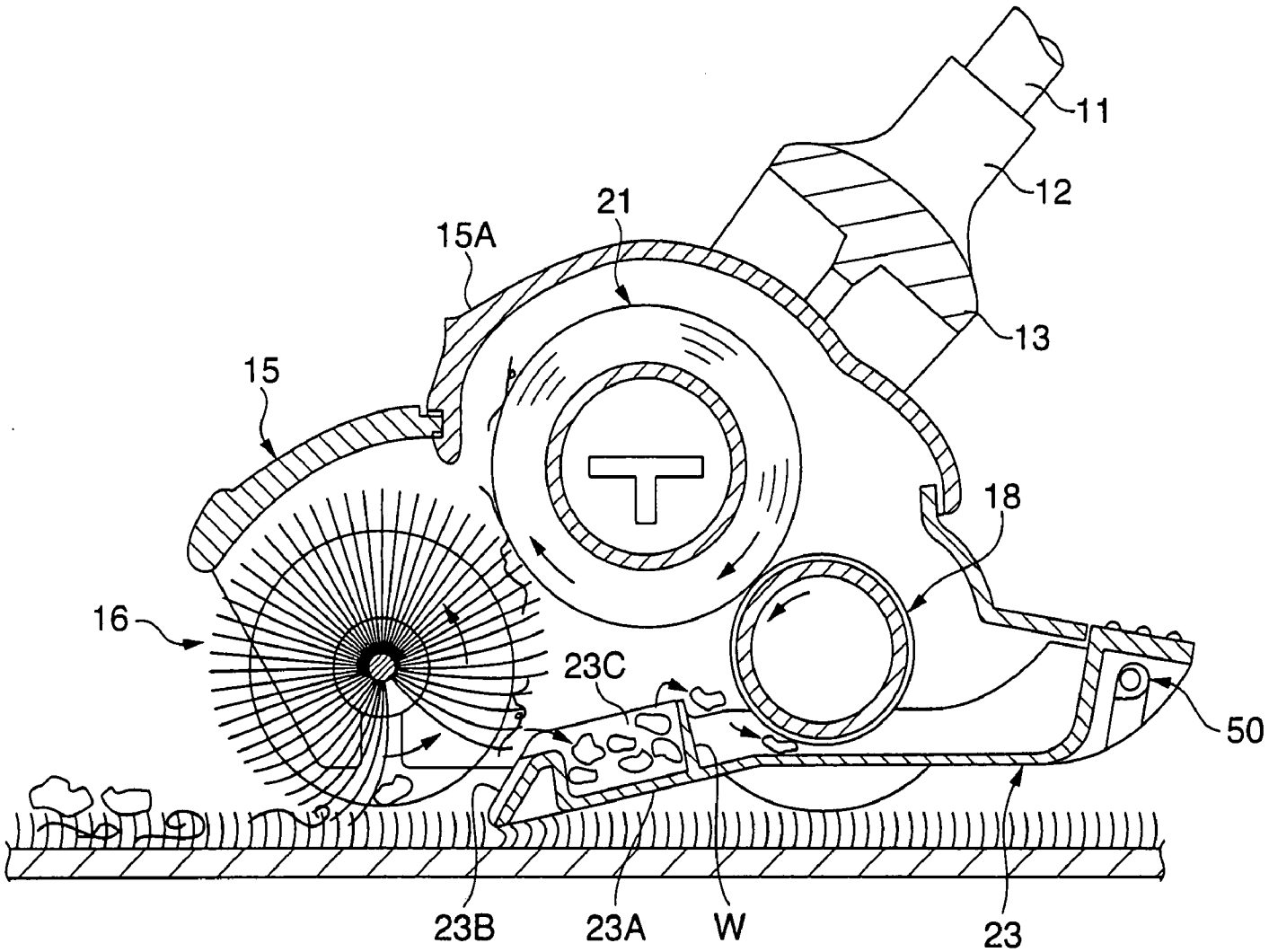
FIG. 19 is a schematic side elevational view showing a comparative embodiment of the cleaning device.

In this case, in the cleaning device 10, as shown in FIG. 19, in the case that the rotating body 18 is constituted by a straight cylinder body, it is necessary to prevent the dust from being pinched into the portion between the rotating body 18 and the dustpan portion 23. Accordingly, in the case that the dustpan portion 23 is provided with a wall W on the front side of the rotating body 18, the dust A does not move to the rear side of the rotating body 18.

(4) Since the rotating body 18 is provided with the annular ring 18C in the outer periphery of the rotating element 18A, the contact area between the rotating element 18A and the adhesive roll 21 becomes small, the rotating element 18A is not stuck to the adhesive roll 21 even when the adhesive force of the adhesive roll 21 is increased, and the rotating body 18 can roll smoothly. Accordingly, the cleaning device 10 securely rotates the adhesive roll 21 having the high adhesive force while smoothly rolling the rotating body 18 on the floor surface, and securely picks up the dust scraped up by the scraping up body 16 by a new adhesive surface of the adhesive roll 21.

(5) As the annular ring 18C, it is possible to employ a low adhesive hard ring such as a fluorine containing resin, Teflon (trade mark) and the like, in addition to a low adhesive soft ring such as a silicone rubber and the like.

(Eighth Embodiment) (FIGS. 20 to 30)

Further, the cleaning device 10 according to the eighth embodiment is structured such that the scraping up body 16 is constituted by the supporting shaft 121, the scraping up member 16A comprising the brush implanted along an entire length of the supporting shaft 121 in the axial direction, and both side tire portions 16B connected to both end portions of the supporting shaft 121. The scraping up member 16A may be in contact with the adhesive roll 21 or in non-contact with the adhesive roll 21. Both side tire portions 16B are arranged at both outer sides of the frame 15 in such a manner that the dust is not pinched into the tire portions 16B, however, they may be arranged in an inner side of the frame 15.

The rotating body 18 is a driving means for the adhesive roll 21, and is constituted by a supporting shaft 131, the disc-shaped rotating elements 18A fixed to both end side positions in an axial direction of the supporting shaft 131 (a plurality of positions such as three positions in the axial direction may be employed), and both side tire portions 18B connected to both end portions of the supporting shaft 131. The rotating element 18A is in contact with the adhesive roll 21. Both side tire portions 18B are arranged at both outer sides of the frame 15.

The cleaning device 10 is provided with (A) a scraping up speed increasing means 160 for increasing the rotation of the tire portion 16B so as to transmit to the scraping up member 16A, and (B) an adhesive roll driving means 180 for rotating the adhesive roll 21, in the following manner.

(A) Scraping up Speed Increasing Means 160

Figure 20:
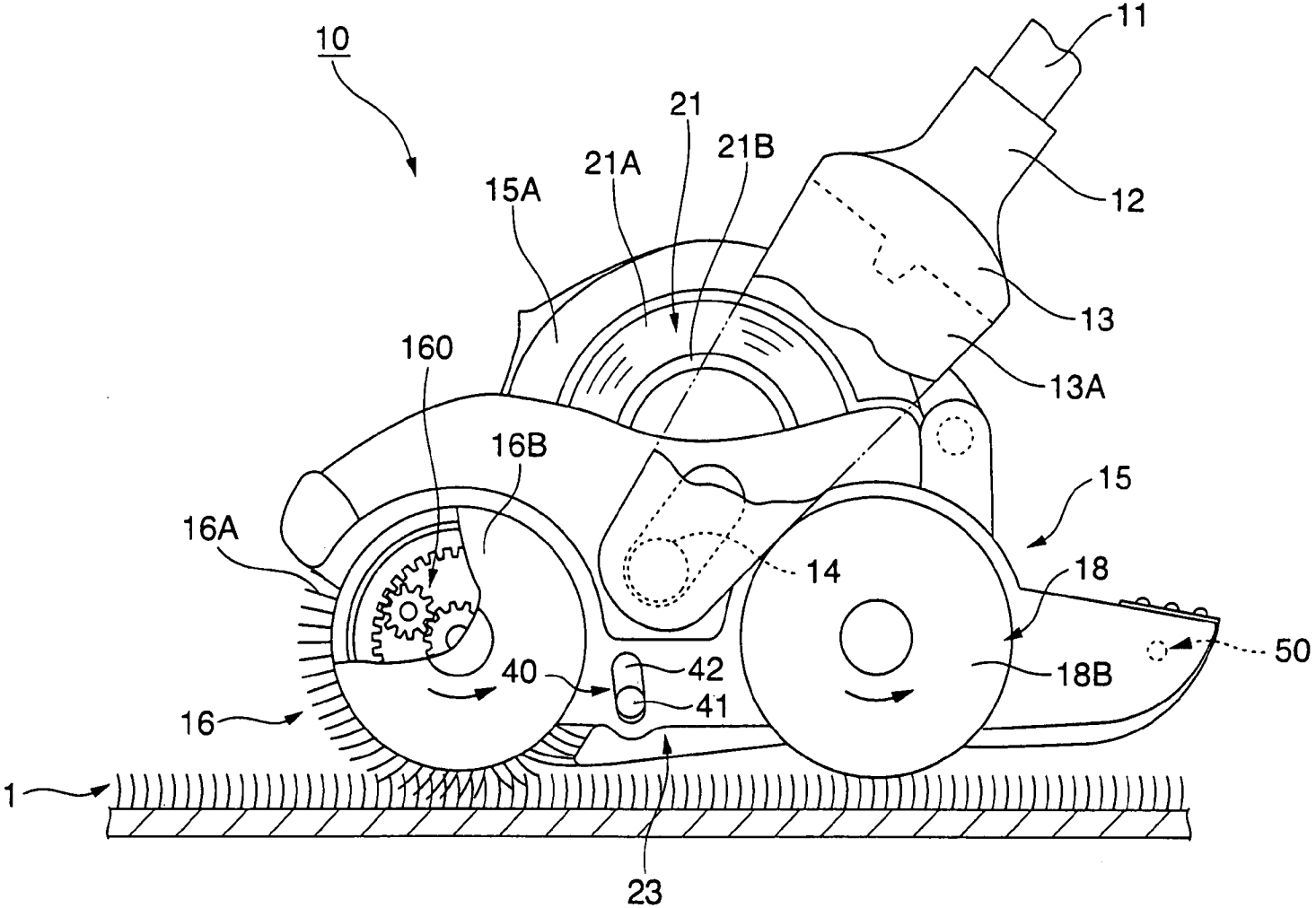
FIG. 20 is a schematic side elevational view showing the cleaning device.

The scraping up speed increasing means 160 increases the speed of the rotation of the tire portions 16B of the scraping up body 16 so as to transmit to the scraping up member 16A, as shown in FIG. 20.

Figure 21:
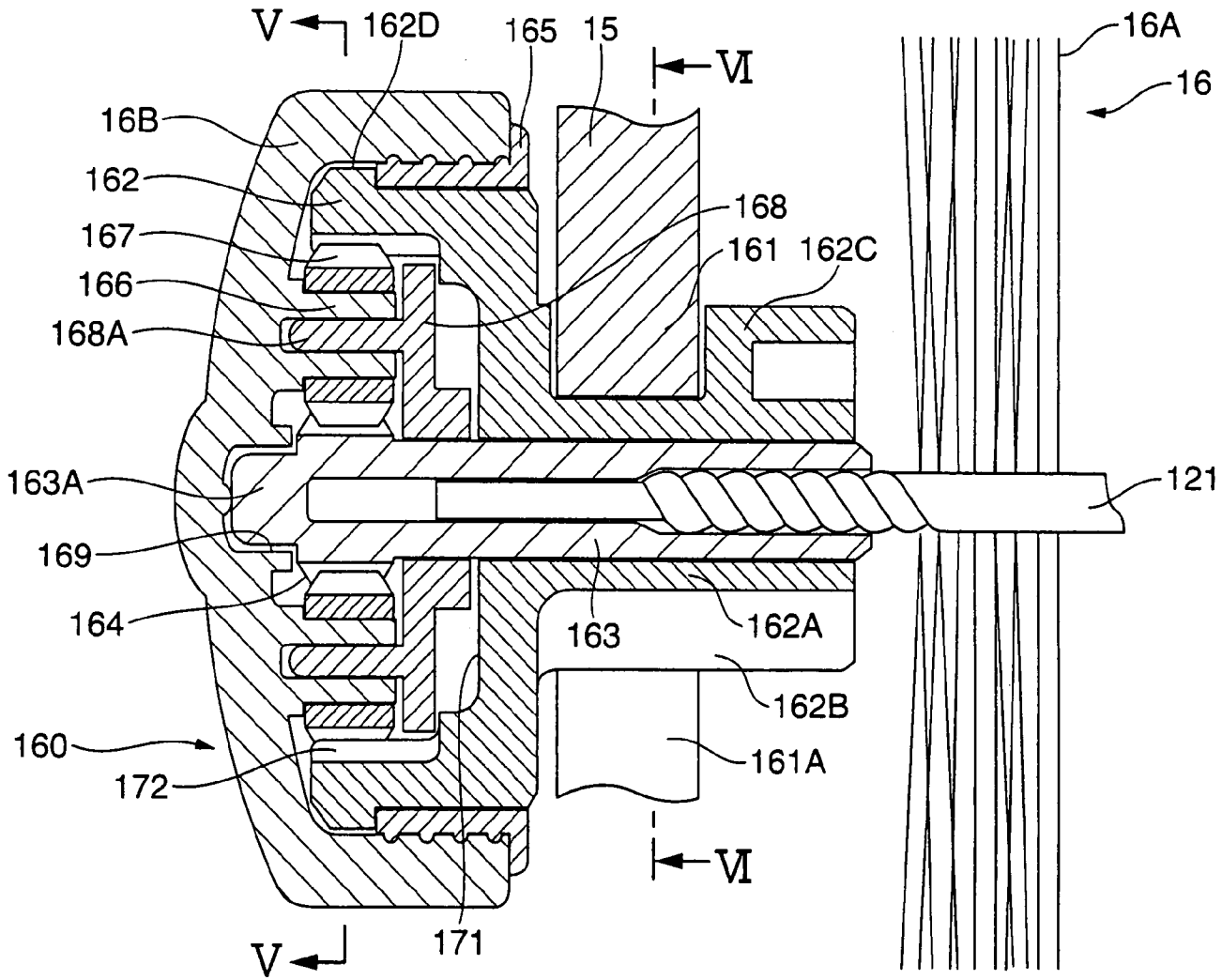
FIG. 21 is a cross sectional view showing a speed increasing means of the scraping up body.
Figure 22:
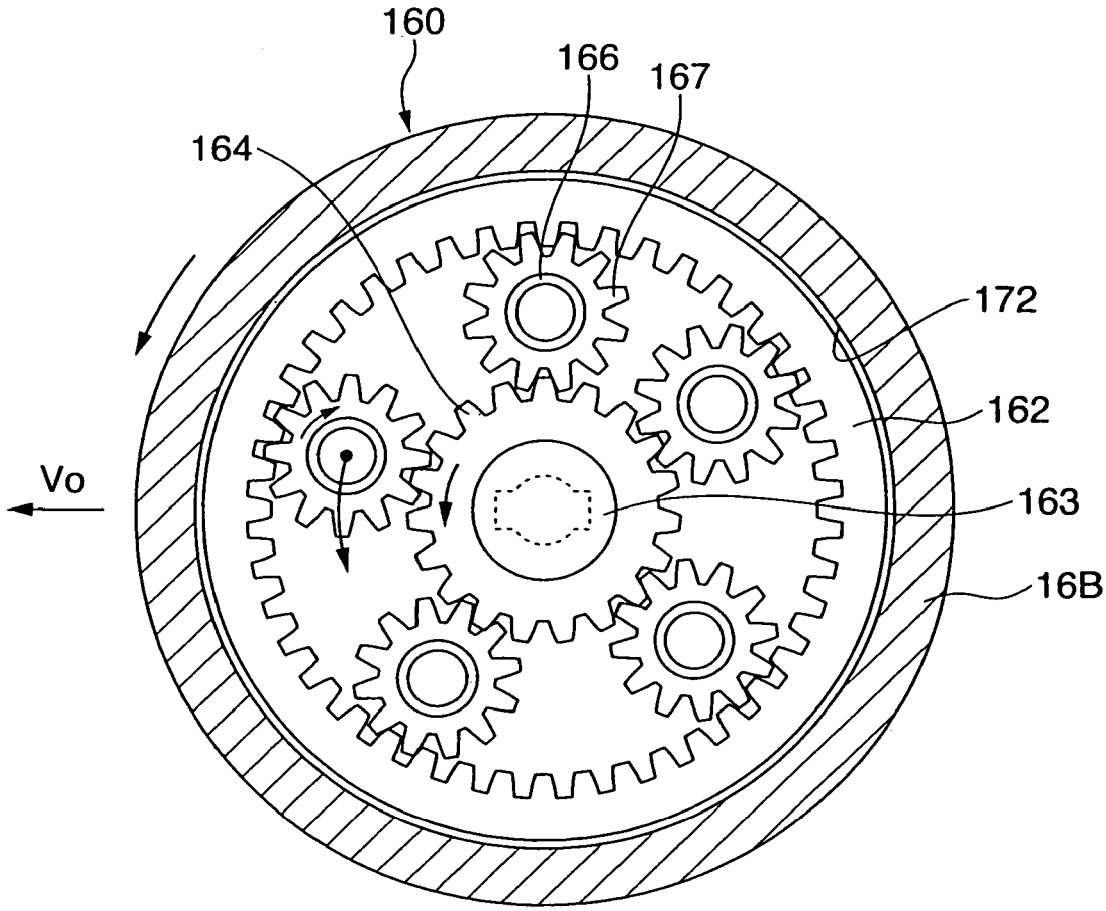
FIG. 22 is a cross sectional view along the line V—V in FIG. 21.
Figure 23:
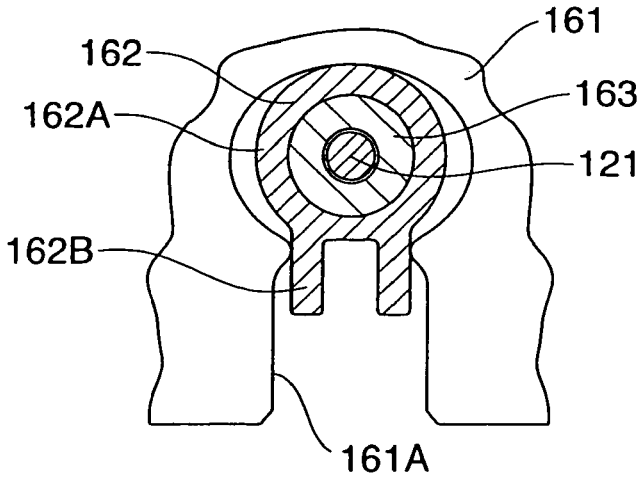
FIG. 23 is a cross sectional view along the line VI—VI in FIG. 21.

The scraping up speed increasing means 160 is structured, as shown in FIGS. 21 to 23, such that a hollow shaft portion 162A of a base 162 is inserted and attached to a pivot portion 161 provided on both side walls of the frame 15, a rotation preventing convex portion 162B of the base 162 is locked to a rotation preventing groove 161A of the pivot portion 161 in a rotational direction, and a come-off preventing swelling portion 162C of the base 162 is brought into contact with an inner side surface of the frame 15, whereby rotation prevention and come-off prevention are achieved.

A sun shaft 163 inserted and engaged with both end portions of the supporting shaft 121 in the scraping up body 16 integrally in the rotational direction is rotatably arranged so as to be inserted to a hollow portion of the hollow shaft portion 162A from an outer side of the base 162, and a sun gear 164 is provided in an outer end portion of the sun shaft 163. The sun gear 164 is provided at the center of rotation of the scraping up body 16.

The cup-shaped tire portion 16B is rotatably fitted to an outer periphery of the base 162. A lock ring 165 is screwed to an opening side inner peripheral portion of the tire portion 16B fitted to the base 162. The tire portion 16B is directly fitted to a large-diameter portion 162D in the outer periphery of the base 162, and is rotatably fitted to a side portion with respect to the large-diameter portion 162D of the base 162 via the lock ring 165.

Planetary shafts 166 are provided in a protruding manner at a plurality of positions in the circumferential direction of the center shaft of the tire portion 16B, on an inner side surface of a side wall of the tire portion 16B, preferably, at a plurality of positions with a uniform interval in the circumferential direction (five uniformly arranged positions with a uniform interval in the circumferential direction in the present embodiment), and a planetary gear 167 is pivoted to each of the planetary shafts 166. The planetary gear 167 is engaged with the sun gear 164, and revolves around the sun gear 164 while rotating around the planetary shaft 166. In this case, each of the planetary shafts 166 is formed as a hollow shaft, and an engagement pin 168A provided in a pressing ring 168 preventing the planetary gear 167 from dropping out from the planetary shaft 166 is inserted and attached to the hollow portion of the planetary shaft 166. A recess portion 169 to which a leading end shaft portion 163A of the sun shaft 163 is inserted is provided in the center portion of a side wall of the tire portion 16B, and the tire portion 16B and the pressing ring 168 are structured such as to freely rotate relative with respect to the sun shaft 163.

An inner peripheral portion of the base 162 is formed as a recess portion 171 receiving the planetary gear 167 and the pressing ring 168, and an inner peripheral portion thereof is provided with an internal gear 172 with which the planetary gear 167 is engaged.

In other words, the scraping up speed increasing means 160 speeds up the rotation of the tire portion 16B by a scale al so as to transmit to the scraping up member 16A, by a planetary gear train constituted by the sun gear 164, the planetary gear 167 and the internal gear 172. On the assumption that a pitch circle diameter of the sun gear 164 is set to d1, a pitch circle diameter of the planetary gear 167 is set to d2, and a pitch circle diameter of the internal gear 172 is set to d3, the relation d3=d1+2d2 and a1=(d3/d1)+1 is established. In the case of the condition d1=12, d2=6 and d3=24, the formula a1=3 is established.

Figure 24:
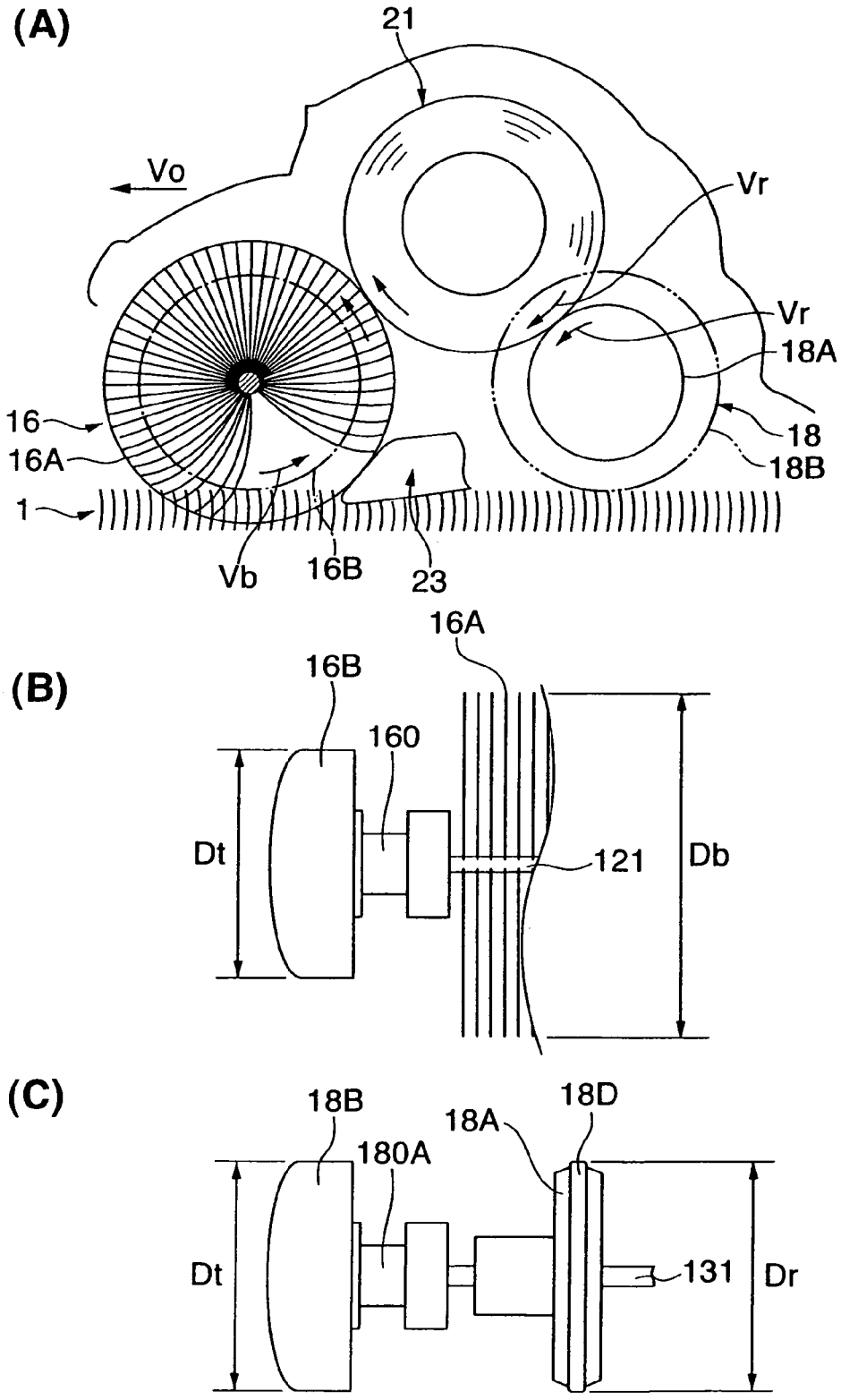
FIG. 24 is a schematic view showing the relation of rotating speed among the scraping up body, the rotating body and the adhesive roll.

As shown in FIG. 24, on the assumption that a moving speed of the cleaning device 10 is set to V0, a diameter of the tire portion 16B is set to Dt, a rotational speed of the tire portion 16B is set to nt, a diameter of the scraping up member 16A is set to Db, a rotational speed of the scraping up member 16A is set to nb, and a circumferential speed of the scraping up member 16A is set to Vb, the following formulas (1) to (3) are established.

$$V0=\pi Dtnt \quad (1)$$

$$nb=a1nt \quad (2)$$

$$Vb=\pi Dbnb=(Db/Dt)a1V0 \quad (3)$$

Further, the scraping up speed increasing means 160 is provided with a connection portion to the scraping up member 16A (a connection portion in which the sun shaft 163 is connected to the supporting shaft 121 of the scraping up member 16A) within a projection surface of the tire portion 16B in an axial view of the tire portion 16B.

Further, the scraping up speed increasing means 160 sets the rotational direction of the scraping up member 16A to the same direction as the rotational direction of the tire portion 16B.

Figure 25:
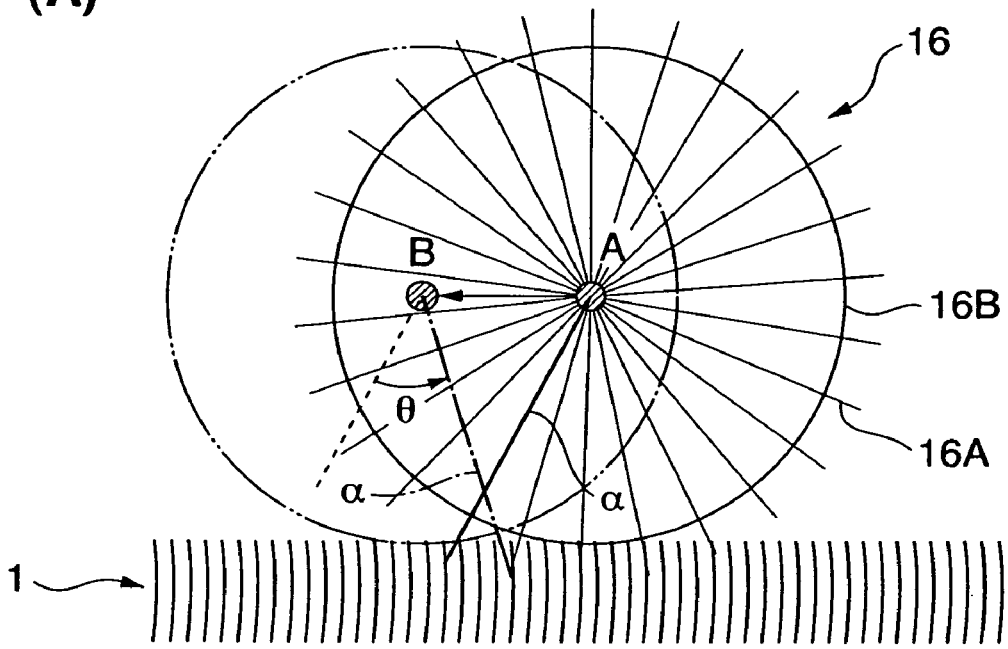
FIG. 25 is a schematic view showing a speed increasing effect of the scraping up body.
Figure 25:
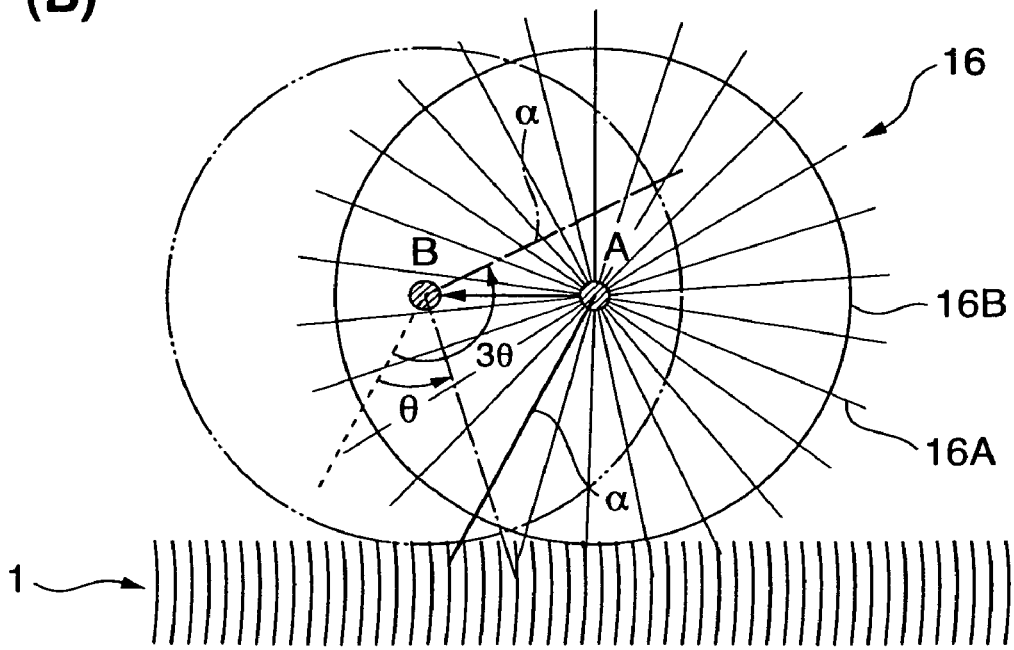

FIG. 25 shows a speed increasing effect of the scraping up member 16A by the scraping up speed increasing means 160. As shown in FIG. 25A, if the rotation of the scraping up member 16A is equal to the rotation of the tire portion 16B (a1=1), an angle of rotation of the scraping up member 16A is θ at a time when the scraping up member 16A moves from a point A to a point B based on a rotational angle θ of the tire portion 16B. Accordingly, the fibers a implanted in the brush of the scraping up member 16A only move from a position of solid line to a position of chain line, the brush implanted fibers a stay at approximately the same position with respect to the floor surface 1, and the brush implanted fibers a only press the dust on the floor surface 1 and can not pick up the hair dust or the like entwined in the carpet or the like. On the contrary, as shown in FIG. 25B, when the rotation of the scraping up member 16A is sped up by triple scale (a1=3), the rotational angle of the scraping up member 16A is 3θ at a time when the scraping up member 16A moves from a point A to a point B based on a rotational angle θ of the tire portion 16B. Accordingly, the brush implanted fibers a of the scraping up member 16A largely move from the solid line position to the dotted-line position, the brush implanted fibers a come into the fibers of the carpet on the floor surface 1, scrape up the dust at a high speed, and can pick up the hair dust or the like entwined in the carpet or the like.

Therefore, according to the cleaning device 10 provided with the scraping up speed increasing means 160, the following effects can be obtained.

(1) The relative speed of the scraping up member 16A is increased with respect to the floor surface, by speeding up the rotation of the scraping up member 16A (the brush) of the scraping up body 16 in comparison with the rotation of the tire portion 16B rolling on the floor surface 1, so that (a) the speed by which the leading end of the brush of the scraping up member 16A comes into the fibers of the carpet or the like becomes faster, the fiber dust entwined in the carpet or the like can be picked up, and it is possible to improve the dust scraping up force by the scraping up member 16A. Further, (b) it is possible to move the dust on the front floor surface of the dustpan portion arranged at the rear side of the scraping up member 16A, to the side of the dustpan portion 23 in a preliminary step toward arrival of the dustpan portion 23, it is possible to pick up the dust between the leading end of the cleaning device 10 and the dustpan portion 23, and it is possible to widen the range which can be cleaned by the cleaning device 10, to an area close to the wall or the like.

(2) Since the connection portion between the speed increasing means 160 for the scraping up member 16A and the scraping up member 16A is provided within the projection surface of the tire portion 16B, the tire portion 16B does not exist between the leading end of the cleaning device 10 and the scraping up member 16A. According to the present embodiment, since the connection portion between the speed increasing means 160 and the center shaft (the supporting shaft 121) of the scraping up member 16A is provided within the projection surface of the tire portion 16B, the entire tire portion 16B does not exist between the leading end of the cleaning device 10 and the center shaft of the scraping up member 16A. Accordingly, it is possible to widen the range which can be cleaned by the cleaning device, to the area close to the wall or the like.

(3) The rotational direction of the scraping up member 16A is set in the same direction as the rotational direction of the tire portion 16B. Accordingly, the direction in which the dust is scraped up from the floor surface by the scraping up member 16A is directed toward the rear side of the direction in which the cleaning device 10 moves for cleaning, and the dust picking means (the adhesive roll 21 and the dustpan portion 23) is provided in the rear side of the scraping up member 16A. Accordingly, the dust picking means does not exist between the leading end of the cleaning device 10 and the scraping up member 16A, and it is possible to widen the range which can be cleaned by the cleaning device 10, to the area close to the wall or the like.

(B) Adhesive Roll Driving Means 180

The adhesive roll driving means 180 is structured by the rotating body 18 mentioned above, and rotates the adhesive roll 21 in an opposite direction to the rotational direction of the scraping up member 16A in the scraping up body 16.

The rotating body 18 rolls on the floor surface while being supported by the frame 15 as mentioned above, and rotates the adhesive roll 21 based on its rotation. Specifically, the rotating body 18 has the tire portion 18B rolling on the floor surface, and disc-like rotating element 18A interlocking with the rotation of the tire portion 18B and rotating the adhesive roll 21 in a state of being in contact with the adhesive roll 21 (the outermost portion of the rotating element 18A is constituted by the annular ring 18D). Since the adhesive roll 21 rotates in contact with the rotating element 18A (the annular ring 18D) without any slip, a circumferential speed Vr of the rotating element 18A (the annular ring 18D) becomes equal to the circumferential speed of the adhesive roll 21.

The adhesive roll driving means 180 has a speed increasing means 180A for speeding up the rotation of the tire portion 18B in the rotating element 18 so as to transmit to the rotating element 18A (the annular ring 18D). The speed increasing means 180A may be constituted by the same planetary gear train as that of the speed increasing means 160 for the scraping up member 16A mentioned above.

Figure 26:
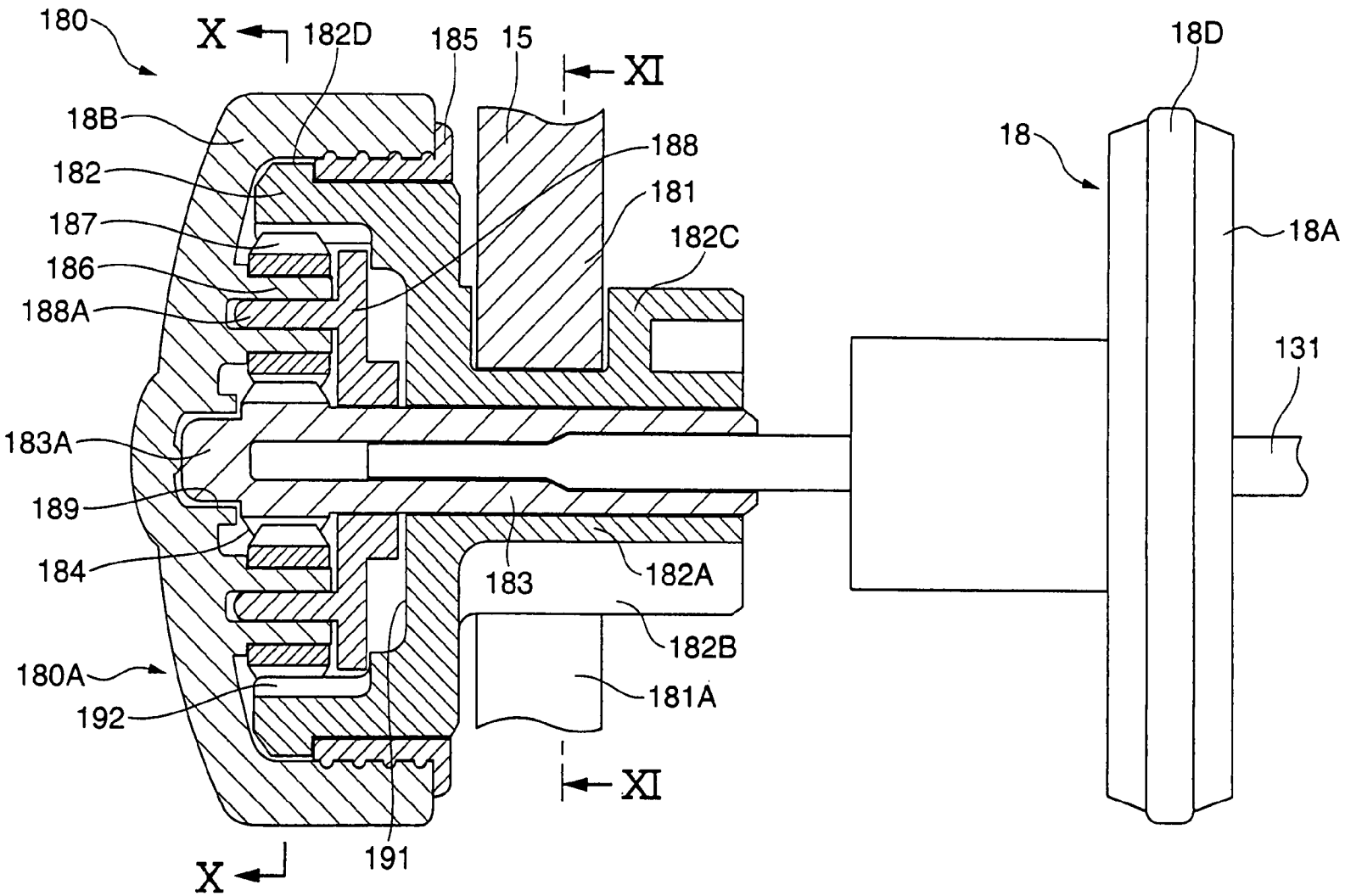
FIG. 26 is a cross sectional view showing the speed increasing means of the rotating body.
Figure 27:
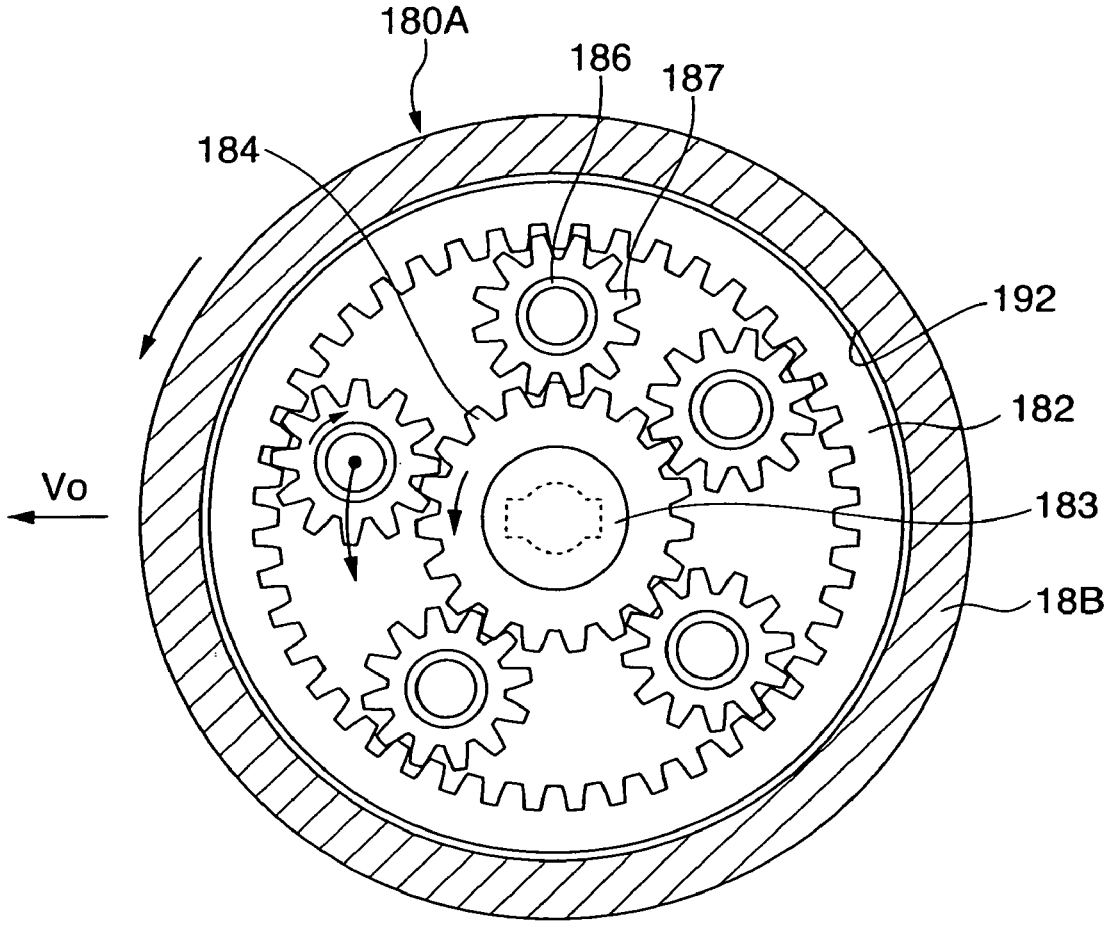
FIG. 27 is a cross sectional view along the line X—X in FIG. 26.
Figure 28:
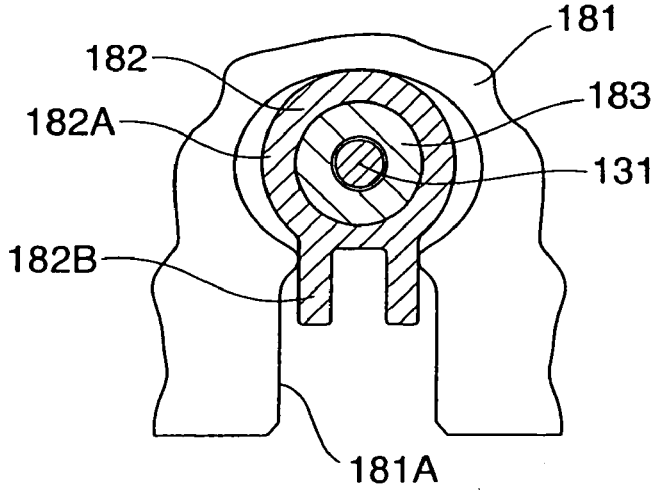
FIG. 28 is a cross sectional view along the line XI—XI in FIG. 26.

In other words, the speed increasing means 180A is structured, as shown in FIGS. 26 to 28, such that a hollow shaft portion 182A of a base 182 is inserted and attached to a pivot portion 181 provided at both side walls of the frame 15, a rotation preventing convex portion 182B of the base 182 is engaged with a rotation preventing groove 181A of the pivot portion 181 in a rotational direction, and a swelling portion 182C of the base 182 is brought into contact with the inner side surface of the frame 15, whereby rotation prevention and a come-off prevention are achieved.

A sun shaft 183 which is engaged by integrally inserting to both end portions of the supporting shaft 131 of the rotating body 18, is arranged in a state of being rotatably inserted to the hollow portion of the hollow shaft portion 182A from an outer side of the base 182, and a sun gear 184 is provided in an outer end portion of the sun shaft 183. The sun gear 184 is provided at the center of rotation of the rotating body 18.

The cup-shaped tire portion 18B is rotatably fitted to an outer periphery of the base 182. A lock ring 185 is screwed with an inner peripheral portion in an opening side of the tire portion 18B fitted to the base 182. The tire portion 18B is directly fitted to a large-diameter portion 182D in an outer periphery of the base 182, and rotatably fitted to a side portion with respect to the large-diameter portion 182D of the base 182 via the lock ring 185.

Planetary shafts 186 are provided in a protruding manner at a plurality of positions (five positions in the present embodiment) in a peripheral direction of the center shaft of the tire portion 18B and in the inner side surface of the side wall of the tire portion 18B, and a planetary gear 187 is pivoted to each of the planetary shafts 186. The planetary gear 187 is engaged with the sun gear 184, and revolves around the sun gear 184 while rotating around the planetary shaft 186. In this case, each of the planetary shafts 186 is formed as a hollow shaft, and an engagement pin 188A provided in a pressing ring 188 preventing the planetary gear 187 from dropping out from the planetary shaft 186 is inserted and attached to the hollow portion of the planetary shaft 186. A recess portion 189 to which a leading end shaft portion 183A of the sun shaft 183 is inserted is provided in a center portion of a side wall of the tire portion 18B, and the tire portion 18B and the pressing ring 188 are structured such as to freely rotate relatively with respect to the sun shaft 183.

An inner peripheral portion of the base 182 is formed as a recess portion 191 receiving the planetary gear 187 and the pressing ring 188, and an inner peripheral portion thereof is provided with an internal gear 192 with which the planetary gear 187 is engaged.

In other words, the speed increasing means 180A speeds up the rotation of the tire portion 18B by a scale a2 so as to transmit to the scraping up member 18A, by a planetary gear train constituted by the sun gear 184, the planetary gear 187 and the internal gear 192. On the assumption that a pitch circle diameter of the sun gear 184 is set to d1, a pitch circle diameter of the planetary gear 187 is set to d2, and a pitch circle diameter of the internal gear 192 is set to d3, the relation d3=d1+2d2 and a2=(d3/d1)+1 is established. In the case of the condition d1=12, d2=6 and d3=24, the formula a2=3 is established.

As shown in FIG. 24, on the assumption that a moving speed of the cleaning device 10 is set to V0, a diameter of the tire portion 18B is set to Dt (on the assumption of being the same diameter of the tire portion 16B of the scraping up body 16), a rotational speed of the tire portion 18B is set to nt, a diameter of the rotating element 18A is set to Dr, a rotational speed of the rotating element 18A is set to nr, and a circumferential speed of the rotating element 18A is set to Vr, the following formulas (4) to (6) are established.

$$V0=\pi Dtnt \tag{4}$$

$$nb=a2nt \tag{5}$$

$$Vb=\pi Drnr=(Dr/Dt)a2V0 \tag{6}$$

In the cleaning device 10, for example, in the case that the relation Dt=34 mm, Dr=20 mm, Db=40 mm, a1=a2=3 is established, the following formulas (7) and (8) are established based on the formulas (3) and (6) mentioned above.

$$Vb/Vr=a1Db/a2Dr=2 \tag{7}$$

$$Vb=2Vr \tag{8}$$

Further, the adhesive roll driving means 180 is provided with a connection portion between the speed increasing means 180A and the rotating element 18A (a connection portion in which the sun shaft 183 is connected to the supporting shaft 131 of the rotating element 18A) within a projection surface of the tire portion 18B in an axial view of the tire portion 18B.

Further, the adhesive roll driving means 180 sets the rotational direction of the rotating element 18A to the same direction as the rotational direction of the tire portion 18B.

Therefore, according to the cleaning device 10 provided with the adhesive roll driving means 180 and the speed increasing means 180A, the following effects can be obtained.

(1) The adhesive roll driving means 180 speeds up the rotating element 18A of the rotating body 18 faster than the rotation of the tire portion 18B, thereby increasing the circumferential speed of the adhesive roll 21 which the rotating element 18A rotates in a contact state. In other words, the rotating element 18 constituting the adhesive roll driving means 180 rotates the adhesive roll 21 at a faster circumferential speed in an opposite direction to the rotational direction of the scraping up member 16A of the scraping up body 16. Accordingly, the scraping up member 16A of the scraping up body 16 and the adhesive roll 21 are opposed to each other, the moving direction of the surface of the adhesive roll 21 is made in conformity with the moving direction of the scraping up member 16A, in the dust transfer area in which the dust scraped up by the scraping up member 16A are transferred to the adhesive roll 21, and the moving speed of the adhesive roll 21 becomes high. Accordingly, after the leading end of the dust such as the hair or the like entwined with the brush implanted fibers of the scraping up member 16A is attached to the adhesive roll 21, the adhesive roll 21 winds up the dust such as the hair or the like so as to remove the dust from the scraping up member 16A, and the winding and picking up property can be improved.

(2) Based on the high speed rotation of the adhesive roll 21 by the adhesive roll driving means 180, it is possible to make a rotational resistance which the adhesive roll 21 applies to the scraping up member 16A of the scraping up body 16 in the dust transfer area mentioned above. Accordingly, it is possible to lighten the force of the cleaning operation applied to the handle 11 for rotating the scraping up body 16 by moving forward the cleaning device 10.

(3) In the case of supporting the scraping up body 16 and the rotating body 18 to the frame 15, arranging the scraping up body 16 on the front side of the cleaning device 10 in the cleaning and moving direction, and arranging the rotating body 18 on the rear side in the cleaning and moving direction, since the speed increasing means 180A is provided in the rotating body 18, the rotational resistance caused by the speeded up load is applied to the tire portion 18B of the rotating body 18, and the tire portion 18B of the rotating body 18 is stably in contact without slipping with respect to the floor surface. Accordingly, a part of the operating force which the user applies to the frame 15 from the handle 11 for moving forward the cleaning device 10 is applied as a pressing force for pressing the tire portion 16B of the scraping up body 16 to the floor surface around the contact point (the supporting point) between the tire portion 18B of the rotating body 18 and the floor surface. Accordingly, the tire portion 16B of the scraping up body 16 rolls on the floor surface with no slip so as to securely rotate the scraping up member 16A, it is possible to strongly scrape up the dust by the scraping up force based on the elastic restoring operation after elastically deflecting the leading end of the scraping up member 16A with respect to the floor surface, and it is possible to make the leading end of the scraping up member 16A to plunge into the deep portion of the fibers in the carpet or the like so as to scrape up well the dust.

(Material of Tire Portion 16B of Scraping Up Body 16)

When cleaning thick-piled carpet, in the case that a material having a large friction resistance against the fibers or the like of the carpet is employed for the surface material of the tire portion 16B in the scraping up body 16, the tire portion 16 securely speeds up the scraping up member 16A with no slippage. In other words, the tire portion 16B is going to rotate with no slip, and is going to apply rotational torque to the scraping up member 16A. However, the scraping up member 16A is deeply buried in the fibers of the carpet so as to be hard to rotate, and the scraping up member 16A is in a state of slowing the rotation of the tire portion 16B. As a result, the tire portion 18B of the rotating body 18 floats up from the floor surface, and there is generated a disadvantage that the cleaning can not be performed. Accordingly, the tire portion 16B can slip with respect to the fibers or the like of the carpet by setting the material of the surface of the tire portion 16B in the scraping up body 16 to the material having a certain degree of small friction resistance, and the disadvantage mentioned above is not generated. Therefore, it is possible to lightly clean up. For example, silicone rubber is not good and soft polyethylene is good. In this case, since the scraping up member 16A rotates on the pattern of the surface of the carpet, the scraping up member 16A does not speed up at a degree that the tire portion 16B slips. However, in thick-piled carpet, the leading end of the scraping up member 16A is deeply buried in the carpet, and the fibers of the carpet freely deflect so as to reduce the entwining of the dust with respect to the fibers. Accordingly, even in the case that the speed increase of the scraping up member 16A is not sufficient, it is possible to achieve the cleaning and scraping up effect of the scraping up member 16A. In this case, in the carpet having thin-piled fibers and a high density, the dust is entwined with the fibers so as to be hard to pick up, however, in this case, since the rigidity of the fibers of the carpet is firm, the contact pressure of the tire portion 16B becomes higher. Therefore, even when the friction coefficient of the surface material of the tire portion 16B is small, a sufficient friction force can be obtained, and the tire portion 16B rotates with no slip so as to speed up the rotation of the scraping up member 16A, so that it is possible to pick up the dust entwined with the fibers of the carpet.

(Material of Tire Portion 18B of Rotating Body 18)

It is preferable that the friction coefficient of the surface material of the tire portion 18B in the rotating body 18 is high. Since the rotating body 18 is in contact with the carpet only by the tire portion 18B, and the rotating element 18A is separated from the carpet, the tire portion 18B is not prevented from rotating. Accordingly, the rotating element 18A does not slow the rotation of the tire portion 18B even in carpet having thick-piled fibers as mentioned above. Further, in carpet having thick-piled fibers, since the tire portion 18B is mounted on the carpet in a floaty manner, the contact pressure of the tire portion 18B is low, however, in the case that the material of the surface material of the tire portion 18B has a large friction coefficient, it is possible to securely rotate the adhesive roll 21 by the rotating body 18. If the adhesive roll 21 smoothly rotates, it is intended to rotate the scraping up member 16A in the direction of scraping up and rotating the scraping up member 16A of the scraping up body 16 which is in contact with the adhesive roll 21. Therefore, the scraping up member 16A is smoothly rotated, and the dust collecting performance is improved. For example, silicone rubber is excellent and soft polyethylene is good.

Figure 29:
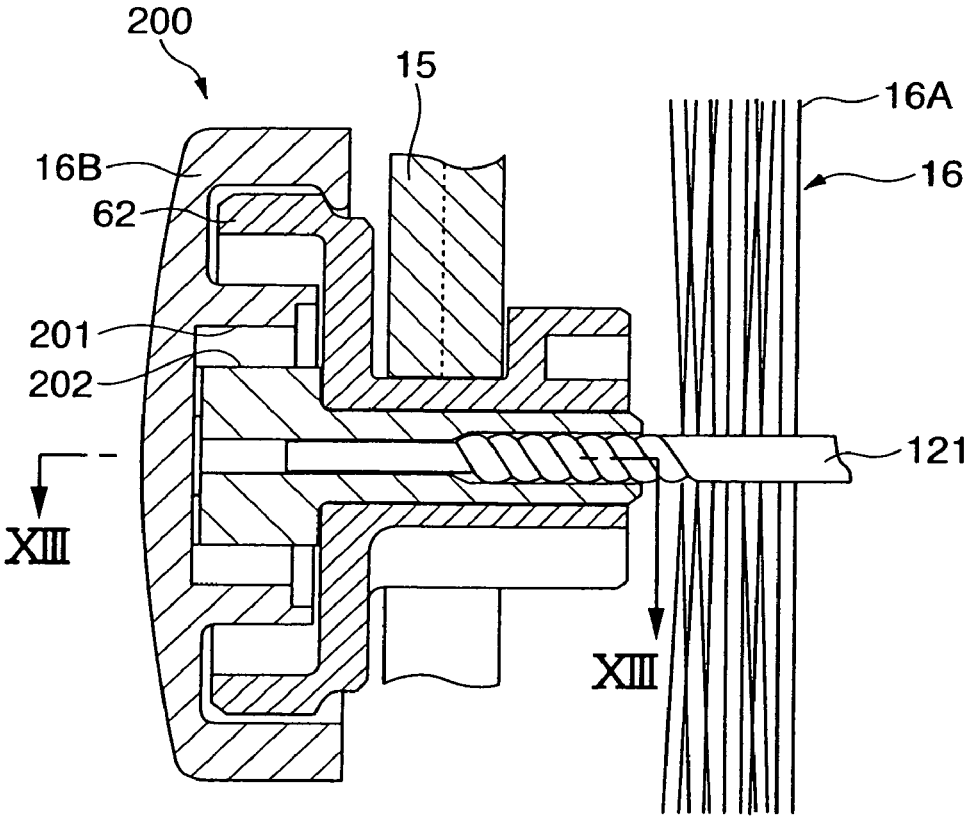
FIG. 29 is a cross sectional view showing another example of the speed increasing means.
Figure 30:
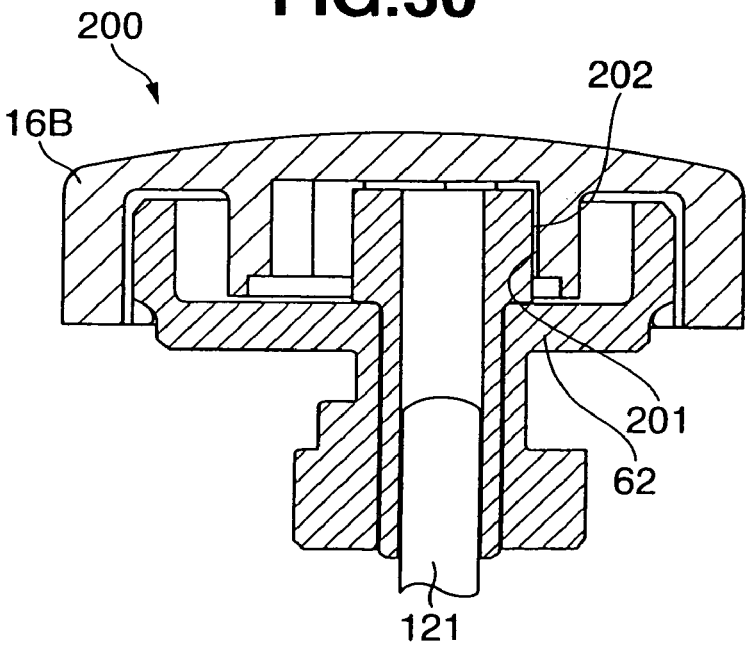
FIG. 30 is a cross sectional view along the line XIII—XIII in FIG. 29.

In this case, the speed increasing means 160 for the scraping up member 16A of the scraping up body 16, and the speed increasing means 180A of the rotating element 18A for the adhesive roll 21 may be constituted by a speed increasing means 200, as shown in FIGS. 29 and 30. The speed increasing means 200 can be structured by a gear train formed by an engagement between a large-diameter internal gear 201 (a large gear) provided around the rotational center of the tire portion 16B (or 18B), and a small-diameter external gear 202 provided around the supporting shaft 121 (or 131) (the rotational center) of the scraping up member 16A. The speed increasing means 200 is structured such that on the assumption that a pitch circle diameter of the large-diameter internal gear 201 is set to da, and a pitch circle diameter of the small-diameter external gear 202 is set to db, a speed increase magnification a1 (or a2)=da/db is established.

In the speed increasing means 200, the connection portion between the small-diameter external gear 202 and the scraping up member 16A (or the rotating element 18A) is provided within the projection surface of the tire portion 16B (or 18B) in the axial view of the tire portion 16B (or 18B).

In the speed increasing means 200, the rotational direction of the scraping up member 16A (or the rotating element 18A) becomes the same direction as the rotational direction of the tire portion 16B (or 18B).

As the adhesive roll used in the present invention, it is possible to employ a structure in which a tubular sheet is detachably put on a core roll. At this time, an original shape of the tubular sheet is formed in a envelope braid-shaped sheet, and a lot of envelope braid-shaped sheets can be laminated on each other so as to be stored.

Further, in the present invention, the scraping up body is not limited to the brush, and a sponge, a rubber blade, an elastomer, an elastic projection body and the like may be employed.

Further, in the present invention, the contact rotating body is not limited to the roll body, and a tire and the like may be employed.

Further, in the present invention, the floor surface means the tatami mat, the flooring, the carpet and the like, and a significant and specific effect can be achieved with respect to the carpet.

INDUSTRIAL APPLICABILITY

As mentioned above, according to the present invention, the scraping up body can securely scrape up the dust while smoothly slipping the dustpan portion on the floor surface, even when the dust is buried in thick-piled carpet.

Further, the cleaning portion can be stably lifted up from the floor surface at a time when the cleaning portion is not used, and the scraping up body can be stably moved forward while being rotated on the floor surface by use of a small force at a time when the scraping up body is being used.

Further, it is possible to simplify the structure for supporting the roll and to improve the workability of attaching and detaching the roll.

Further, it is possible to reduce the dust which fails to be caught at a time when the scraping up body scrapes up the dust while being in slidable contact with the scooping surface portion of the dustpan portion. Further, it is possible to lighten the operating force for moving forward the cleaning device.

Further, it is possible to make the forward moving operation feeling of the cleaning device lithe, and to continuously scrape up all the large and small dust by means of the scraping up body.

Further, the scraping up body can securely scrape up the dust while the dustpan portion smoothly slips on the floor surface, even when the dust is buried in the fibers of thick-piled carpet.

Further, it is possible to smoothly rotate the adhesive roll for adhering and picking up the dust by the rotating body, in the cleaning device.

Further, it is possible to secure the dust holding capacity of the dustpan portion, and to improve the visibility of the dust accumulating state, in the cleaning device.

Further, it is possible to widen the cleaning range on the floor surface to a portion close to the wall or the like, while increasing the relative speed of the scraping up member of the scraping up body with respect to the floor surface so as to improve the dust scraping up capacity, in the cleaning device.

Further, it is possible to improve the performance of taking up and picking up the dust such as the hair or the like entwined with the scraping up member of the scraping up body onto the adhesive roll, in the cleaning device.

What is claimed is:

1. A cleaning device comprising:

a scraping up body and a dust picking means supported to a frame, said dust picking means including an adhesive for adhering dust to said dust picking means;

a tire by which the scraping up body rolls on a floor surface; and a scraping up member which is capable of rotatably interlocking with a rotation of the tire, and scraping up dust from the floor surface to a side of the dust picking means, wherein a speed increasing means for speeding up the rotation of the tire so as to transfer to the scraping up member is provided, and when viewing in an axial direction of the tire, a connection portion between the speed increasing means and the scraping up member is provided within a projection surface of the tire.

2. A cleaning device comprising:

a scraping up body and a dust picking means supported to a frame, said dust picking means including an adhesive for adhering dust to said dust picking means;

a tire by which the scraping up body rolls on a floor surface; and a scraping up member which is capable of rotatably interlocking with a rotation of the tire, and scraping up dust from the floor surface to a side of the dust picking means, wherein a speed increasing means for speeding up the rotation of the tire so as to transfer to the scraping up member is provided, and a rotational direction of the scraping up member is set to the same direction as a rotational direction of the tire.

3. A cleaning device according to claim 1 or 2, wherein the speed increasing means is a planetary gear train constituted by a sun gear which is provided in a rotation center of the scraping up member, a planetary gear which is pivoted to the tire so as to be engaged with the sun gear, and revolves around the sun gear, and an internal gear which is fixed to a side of the frame and engaged with the planetary gear.

4. A cleaning device according to claim 1 or 2, wherein the speed increasing means is a gear train constituted by an engagement between a large-diameter internal gear which is provided around a rotation center of the tire, and a small-diameter external gear which is provided around a rotation center of the scraping up member.

5. A cleaning device comprising:

a scraping up body and an adhesive roll supported to a frame in parallel, wherein the adhesive roll picks up dust from a floor surface scraped up by the scraping up body, the cleaning device has a roll driving means for rotating the adhesive roll in an opposite direction to a rotational direction of the scraping up body, the roll driving means is constituted by a rotating body which rolls on the floor surface while being supported to the frame, and rotates the adhesive roll based on the rotation, the rotating body has a tire rolling on the floor surface, and a rotating element rotating the adhesive roll interlocking with the rotation of the tire, and a speed increasing means for speeding up the rotation of the tire so as to transmit to the rotating element is provided.

6. A cleaning device according to claim 5, wherein the speed increasing means is a planetary gear train constituted by a sun gear which is provided in a rotation center of the rotating element, a planetary gear which is pivoted to the tire so as to be engaged with the sun gear, and revolves around the sun gear, and an internal gear which is fixed to a side of the frame and engaged with the planetary gear.

7. A cleaning device according to claim 5, wherein the speed increasing means is a gear train constituted by an engagement between a large gear which is provided around a rotation center of the tire, and a small gear which is provided around a rotation center of the rotating element.

8. A cleaning device comprising:

a scraping up body and a dust picking means supported to a frame;

a tire by which the scraping up body rolls on a floor surface; and a scraping up member which is capable of rotatably interlocking with a rotation of the tire, and scraping up dust from the floor surface to a side of the dust picking means, wherein a speed increasing means for speeding up the rotation of the tire so as to transfer to the scraping up member is provided, and when viewing in an axial direction of the tire, a connection portion between the speed increasing means and the scraping up member is provided within a projection surface of the tire, and the speed increasing means is a planetary gear train constituted by a sun gear which is provided in a rotation center of the scraping up member, a planetary gear which is pivoted to the tire so as to be engaged with the sun gear, and revolves around the sun gear, and an internal gear which is fixed to a side of the frame and engaged with the planetary gear.

9. A cleaning device comprising:

a scraping up body and a dust picking means supported to a frame;

a tire by which the scraping up body rolls on a floor surface; and a scraping up member which is capable of rotatably interlocking with a rotation of the tire, and scraping up dust from the floor surface to a side of the dust picking means, wherein a speed increasing means for speeding up the rotation of the tire so as to transfer to the scraping up member is provided, and a rotational direction of the scraping up member is set to the same direction as a rotational direction of the tire, and the speed increasing means is a planetary gear train constituted by a sun gear which is provided in a rotation center of the scraping up member, a planetary gear which is pivoted to the tire so as to be engaged with the sun gear, and revolves around the sun gear, and an internal gear which is fixed to a side of the frame and engaged with the planetary gear.

10. A cleaning device comprising:

a scraping up body and a dust adhering body supported to a frame, said dust adhering body including an adhesive for adhering dust thereto;

a tire by which the scraping up body rolls on a floor surface;

a scraping up member which is capable of rotatably interlocking with a rotation of the tire, and scraping up dust from the floor surface to a side of the dust adhering body; and a speed increasing device configured to speed up the rotation of the tire, wherein when viewing in an axial direction of the tire, a connection portion between the speed increasing device and the scraping up member is provided within a projection surface of the tire.

11. A cleaning device comprising:

a scraping up body and a dust adhering body supported to a frame, said dust adhering body including an adhesive for adhering dust thereto;

a tire by which the scraping up body rolls on a floor surface;

a scraping up member which is capable of rotatably interlocking with a rotation of the tire, and scraping up dust from the floor surface to a side of the dust adhering body; and a speed increasing device configured to speed up the rotation of the tire, wherein a rotational direction of the scraping up member is set to the same direction as a rotational direction of the tire.

12. A cleaning device according to claim 10 or 11, wherein the speed increasing device is a planetary gear train constituted by a sun gear which is provided in a rotation center of the scraping up member, a planetary gear which is pivoted to the tire so as to be engaged with the sun gear, and revolves around the sun gear, and an internal gear which is fixed to a side of the frame and engaged with the planetary gear.

13. A cleaning device according to claim 10 or 11, wherein the speed increasing device is a gear train constituted by an engagement between a large-diameter internal gear which is provided around a rotation center of the tire, and a small-diameter external gear which is provided around a rotation center of the scraping up member.

14. A cleaning device comprising:

a scraping up body and an adhesive roll supported to a frame in parallel; and wherein the adhesive roll picks up dust from a floor surface scraped up by the scraping up body, the cleaning device has a roll drive configured to rotate the adhesive roll in an opposite direction to a rotational direction of the scraping up body, the roll drive is a rotating body which rolls on the floor surface while being supported to the frame, and rotates the adhesive roll based on the rotation, and the rotating body has a tire rolling on the floor surface, and a rotating element rotating the adhesive roll interlocking with the rotation of the tire, and a speed increasing device configured to speed up the rotation of the tire.

15. A cleaning device according to claim 14, wherein the speed increasing device is a planetary gear train constituted by a sun gear which is provided in a rotation center of the rotating element, a planetary gear which is pivoted to the tire so as to be engaged with the sun gear, and revolves around the sun gear, and an internal gear which is fixed to a side of the frame and engaged with the planetary gear.

16. A cleaning device according to claim 14, wherein the speed increasing device is a gear train constituted by an engagement between a large gear which is provided around a rotation center of the tire, and a small gear which is provided around a rotation center of the rotating element.

* * * * *